United States Patent [19]

Dietrich

[11] Patent Number: 4,689,610

[45] Date of Patent: Aug. 25, 1987

[54] ACCESS CONTROL AND SECURITY ALARM APPARATUS AND METHOD

[75] Inventor: William V. Dietrich, Fairfax, Va.

[73] Assignee: Kastle Systems, Inc., Arlington, Va.

[21] Appl. No.: 661,810

[22] Filed: Oct. 17, 1984

[51] Int. Cl.[4] ..... G08B 13/00

[52] U.S. Cl. ..... 340/515; 340/528; 340/541

[58] Field of Search ..... 340/541, 528, 514, 515, 340/539, 63, 825.31, 825.32

[56] References Cited

U.S. PATENT DOCUMENTS

| | | | |
|---|---|---|---|
| 3,803,576 | 4/1974 | Dobrzanski et al. | 340/528 |
| 4,023,139 | 5/1977 | Samburg | 340/541 X |
| 4,074,248 | 2/1978 | Stockdale | 340/528 |
| 4,257,038 | 3/1981 | Rounds et al. | 340/541 X |
| 4,543,568 | 9/1985 | Hwang | 340/528 |

*Primary Examiner*—Glen R. Swann, III
*Assistant Examiner*—Thomas J. Mullen, Jr.
*Attorney, Agent, or Firm*—Finnegan, Henderson, Farabow, Garrett & Dunner

[57] ABSTRACT

Access control and security alarm apparatus protects a building including a plurality of protection zones and an electrically locked door. The electrically locked door can be associated with any of the zones without re-wiring. Each zone can be operated to an autosecure condition wherein the zone, after being switched from a secure mode to an access mode to permit authorized entry, is automatically switched back to the secure mode without further action by the user. The apparatus can also be operated to a master reset mode wherein an alarm signal generated in response to activation of a sensor is immediately reset upon deactivation of the sensor to permit the system including each sensor to be conveniently tested by a single operator.

23 Claims, 19 Drawing Figures

PANEL INPUT/OUTPUT
LEDS

| RIM# | 1 | 2 | 3 | 4 |
|---|---|---|---|---|
| HOST INPUT | 82 | 82 | 82 | 82 |
| | 82a | 82a | 82a | 82a |
| HOST OUTPUT | 84 | 84 | 84 | 84 |
| | 84a | 84a | 84a | 84a |
| EXTERNAL INPUT | 86 | 86 | 86 | 86 |
| | 86a | 86a | 86a | 86a |
| EXTERNAL OUTPUT | 88 | 88 | 88 | 88 |
| | 88a | 88a | 88a | 88a |

START
IS IT A WARM RESTART?
102
YES
NO
104
DO WARM RESTART INITIALIZATION
105
SEND WARM RESTART MSG
106
DO COLD RESTART INITIALIZATION
110
SEND COLD RESTART MSG
IS INPUT HOST BUFFER CHANGED ?
112
YES
NO
SEND CHANGE TO HOST
114
IS CHANGE HI ?
IS DOOR CTL BIT CHANGED ?
116
YES
NO
118
YES
NO
120
CALL OPEN DOOR ROUTINE
CALL CLOSE DOOR ROUTINE
122
IS THERE A SYSTEM HARDWARE FAILURE ?
124
YES
NO
SEND TBL REPORT TO HOST
113

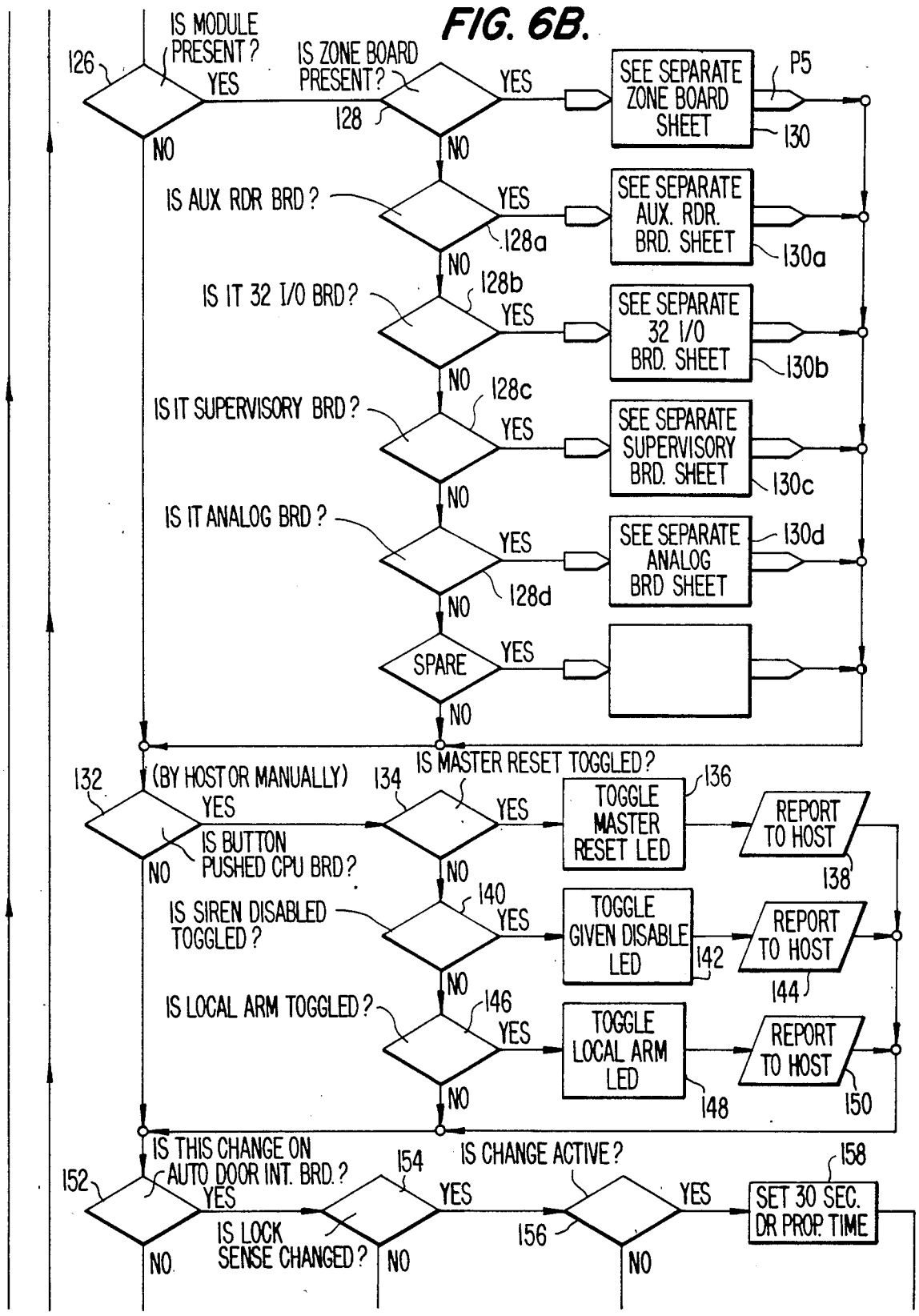
FIG. 6B.
IS MODULE PRESENT?
126
YES
NO
IS ZONE BOARD PRESENT?
128
YES
NO
SEE SEPARATE ZONE BOARD SHEET
P5
130
IS AUX RDR BRD?
128a
YES
NO
SEE SEPARATE AUX. RDR. BRD. SHEET
130a
IS IT 32 I/O BRD?
128b
YES
NO
SEE SEPARATE 32 I/O BRD. SHEET
130b
IS IT SUPERVISORY BRD?
128c
YES
NO
SEE SEPARATE SUPERVISORY BRD. SHEET
130c
IS IT ANALOG BRD?
128d
YES
NO
SEE SEPARATE ANALOG BRD SHEET
130d
SPARE
YES
NO
132
(BY HOST OR MANUALLY)
YES
NO
IS BUTTON PUSHED CPU BRD?
134
IS MASTER RESET TOGGLED?
YES
NO
TOGGLE MASTER RESET LED
136
REPORT TO HOST
138
IS SIREN DISABLED TOGGLED?
140
YES
NO
TOGGLE GIVEN DISABLE LED
142
REPORT TO HOST
144
IS LOCAL ARM TOGGLED?
146
YES
NO
TOGGLE LOCAL ARM LED
148
REPORT TO HOST
150
152
IS THIS CHANGE ON AUTO DOOR INT. BRD.?
YES
NO
154
IS LOCK SENSE CHANGED?
YES
NO
IS CHANGE ACTIVE?
156
YES
NO
158
SET 30 SEC. DR PROP. TIME

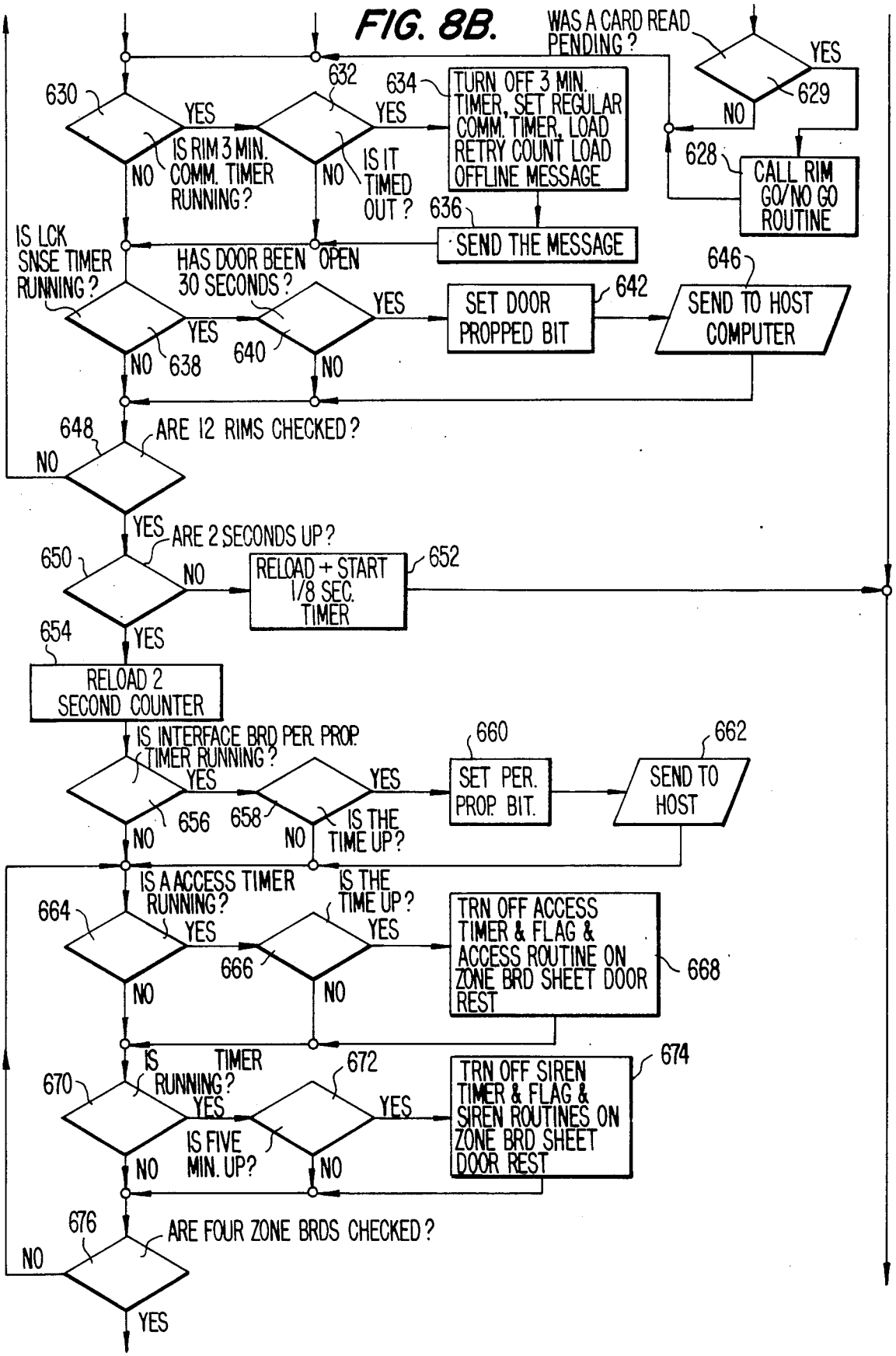
FIG. 8B.
WAS A CARD READ PENDING?
YES
NO
629
628
CALL RIM GO/NO GO ROUTINE
630
IS RIM 3 MIN. COMM. TIMER RUNNING?
632
IS IT TIMED OUT?
634
TURN OFF 3 MIN. TIMER, SET REGULAR COMM. TIMER, LOAD RETRY COUNT LOAD OFFLINE MESSAGE
636
SEND THE MESSAGE
IS LCK SNSE TIMER RUNNING?
HAS DOOR BEEN OPEN 30 SECONDS?
638
640
SET DOOR PROPPED BIT
642
646
SEND TO HOST COMPUTER
648
ARE 12 RIMS CHECKED?
650
ARE 2 SECONDS UP?
652
RELOAD + START 1/8 SEC. TIMER
654
RELOAD 2 SECOND COUNTER
IS INTERFACE BRD PER. PROP. TIMER RUNNING?
656
658
IS THE TIME UP?
660
SET PER. PROP. BIT.
662
SEND TO HOST
664
IS A ACCESS TIMER RUNNING?
666
IS THE TIME UP?
668
TRN OFF ACCESS TIMER & FLAG & ACCESS ROUTINE ON ZONE BRD SHEET DOOR REST
670
IS TIMER RUNNING?
672
IS FIVE MIN. UP?
674
TRN OFF SIREN TIMER & FLAG & SIREN ROUTINES ON ZONE BRD SHEET DOOR REST
676
ARE FOUR ZONE BRDS CHECKED?

ACCESS CONTROL AND SECURITY ALARM APPARATUS AND METHOD

BACKGROUND

The invention relates to access control and security alarm apparatus and, more particularly, to apparatus of this type in which a central station monitors a plurality of remote facilities.

There is a continuing need to provide security and access control for commercial and residential buildings. Traditional methods using simple burglar alarms and uniformed security guards are becoming increasingly expensive and ineffective.

A method which provides a high level of security at reasonable, cost uses a central station to monitor a number of remote locations which are connected to and communicate with the central station over telephone lines. An example of such a system is that described U.S. Pat. No. 4,023,139 issued May 10, 1977 to Samburg. The system described in this patent is very effective in providing security at a reasonable cost by eliminating the need for uniformed security guards at each remote facility.

Conventional security systems, however may suffer from the failure of users at the remote facilities to perform certain procedures. For example, users sometimes fail to reestablish the most secure condition of the system after requesting authorized entry to the protected area.

This drawback can partially be overcome by increased vigilance on the part of central station monitoring personnel to detect such failures by the user. However, such measures have not been totally effective. Accordingly, an objective of the present invention is an access control and security alarm apparatus which maintains a high level of protection which requires a minimum of action by users at remote facilities.

Since access control and security alarm systems are designed to provide security for both persons and property, such systems must be carefully installed and tested. Furthermore, to maintain a high level of protection and confidence in the system, periodic testing is desirable subsequent to installation. Each sensor must be tested upon installation and periodically thereafter to determine whether it is operating properly. Such testing is performed, for example, on door position sensors by opening the door or entry device and observing if an alarm signal is generated. After such an alarm signal occurs, then the system must be reset before testing the next sensor. Since for maximum security the reset control is not usually located near the sensors, at least two people are usually required to test the entire system. It is therefore a further objective of the present invention to reduce the cost and complexity of such testing.

In prior art access control and security alarm systems having multiple protection zones, electrically locked doors operated in association with identification card readers were often used to provide controlled access by authorized persons to a specific protection zone. However, in such prior art systems, electrically locked doors and associated identification card readers were hard-wired into the systems such that the door and reader could only be associated with a single zone. In commercial buildings where tenants often desire to expand or modify their facilities, such hard-wired systems greatly limit the flexibility of users. It is therefore an additional objective of the invention to provide a multiple-zone access control and security alarm system which can easily associate an electrically locked door with any desired protection zone.

In many buildings for which access control and security protection is desired, remotely operated access control systems are provided which include an electrically locked door and an entry authorization device such as an identification card reader or a numeric keypad. Such systems have been successfully integrated into prior art access control and security alarm systems by wiring the remotely operated access control system to the associated protection zones. Thus, the system was fixedly associated with that zone such that violation of the security of the system would cause an alarm for its associated zone only. This limited flexibility of the entire system, and, once installed, prevents the remotely operated access control system from being easily integrated into another protection zone. Accordingly, it is an objective of the present invention to provide an access control and security alarm system having a plurality of protection zones and a plurality of remotely operated access control systems which can be simply and conveniently configured to associate any remotely operated access control system with any protection zone.

SUMMARY OF THE INVENTION

The present invention provides an access control and security alarm apparatus including a central station having a host computer connected to a plurality of remote locations by a communication channel. The remote locations are typically buildings located at distances of up to 1500 miles from the central location. Each remote station includes one or more master control devices, each connected to a number of input and output devices. Each master control device provides access control and security alarm functions for a plurality of protection zones.

A remote location typically consists of a commercial office building having a main entrance and lobby serving a number of separate office suites. Each office suite may be occupied by a separate tenant in the building and may constitute a separate protection zone served by a master control device.

Input devices to the master control device include one or more condition sensors for each zone connected in a loop to two terminals of the master control device. Such sensors may be any generally known type of normally closed switch contacts mounted, for example, in doors or windows such that the switch contacts open when the associated door or window is opened. Other input devices may include a tamper circuit consisting of a series circuit through the various components of the remote station such that unauthorized modification or removal of any of the security equipment will cause an open circuit in the tamper loop which will, in turn, generate an alarm condition in the master control device. An access/secure key switch is also provided for each protection zone for setting each zone in either an access condition permitting entry through doors in the protection zone without generating an alarm signal or a secure condition in which alarms will be generated by entry into the zone.

Each master control device may also have associated with it a plurality of authorized entry devices such as numeric keypads or identification card readers. These devices are usually placed in proximity to a door having an electrically operated lock which normally maintains the door in a locked condition. An authorized user must enter a specified numeric key sequence into a numeric keypad or insert a properly coded identification card into the card reader to obtain entry. Signals are passed from the keypad or card reader to the master control device and transmitted over the communication channel to the host computer. If the identification card is determined by a computer at the host location to represent an authorized user for the current time and location, the host computer sends a signal back over the communication channel to the master control device which then unlocks the electrically operated lock and permits the authorized user to pass through the door. Each master control device also generally includes exit push-button switches for protection zones having electrically locked doors located inside the door to permit the door to be opened without a card.

Output devices for each master control device include, in addition to the control signals for the electrically operated lock, a control panel having a plurality of indicator lights which signal the status of the master control device and the various protection zones served by the master control device, and a plurality of sirens or other alarm indicators, one for each zone.

In order for an alarm signal to be generated in a protection zone, three conditions must be present. First, the zone must be placed in the arm mode by a signal from the central station. Second, the user at the remote location must operate his zone from the access mode to the secure mode by operating an access/ secure key switch. At this point, the protection zone is armed and secured such that the third condition, which is a subsequent entry through a door or window protected by a sensor connected to the master control device, will cause an alarm signal to be generated. Once such an alarm occurs, it can only be reset by one of the following actions: (1) activation of a reset switch at the master control device, (2) an authorized entry generated either by a proper identification card or numeric keypad entry, (3) activation of the entry switch at the appropriate authorized entry device, (4) putting zone in access mode, or (5) receipt of a reset signal from central station. It is to be noted that removal of the third condition for alarm signal generation, such as closing the door which activated a sensor, will not result in a reset condition and the alarm signal will continue to be generated.

The present invention achieves the desired objectives by providing an access control and security alarm apparatus which permits a single operator to effectively test each sensor by placing the apparatus in a "master reset" mode, sequentially testing each sensor by producing the condition it was desired to detect (such as opening a door), and observing the production of an appropriate alarm signal. Removal of the condition (that is, closing of the door) when the system is in the master reset mode will cause the immediate deactivation of the alarm signal. The next sensor is then tested by producing the condition it was designed to detect and observing the production of an associated alarm signal. Removal of the detected condition will also cause cessation of the alarm signal. In a similar manner, each sensor served by a master control device can be easily tested by a single maintenance person without the need to return to the master control station to provide a reset of the generated alarm condition, as was required in apparatus of prior art.

The present invention also provides maximum security with increased convenience to the user through an "autosecure" mode. As in previous systems, generation of an alarm signal requires that two conditions be present before activation of a sensor will cause an alarm signal. First, the zone must be placed in an armed condition by the generation of an arm signal from the central station to the specified protection zone. Second, the user at this zone must operate the zone to a secure mode through activation of a key switch. Activation of any sensor following these two actions will result in the production of an alarm signal.

If it is desired to enter the protection zone when the zone is both armed and secure, it is necessary for the user to once again activate the key switch to place the zone in the access mode. Entry through a protected door can thus be achieved without the generation of an alarm signal. However, in order to return the zone to its condition of greater security, the user must remember to once again activate the key switch to place the zone in the secure mode. The present invention provides that the central station may generate an autosecure signal which, when transmitted to the master control device at the remote location, places a specified zone in a secure and an autosecure mode. The autosecure mode specifies that when the user activates the key switch to place the zone in the access mode and enters through a door, the master control device will automatically return the zone to the secure mode after expiration of a predetermined delay period, such as 30 seconds. In the event the door is still open at the time of expiration of the delay period, the master control device will place the zone into the secure mode only at such time as the door is once again returned to the closed position. Similarly, if a door is open when the autosecure command is received by the master control device for this zone from the central station, the zone is placed in the secure mode only when the door is closed. In this manner, maximum security can be maintained for the zone with minimum inconvenience to the user.

To achieve the objects and in accordance with the purpose of the invention as embodied and broadly described herein, an access control and security alarm apparatus comprises a plurality of sensors activated in response to a predetermined condition, an alarm indicator, and control means for activating the alarm indicator upon activation of at least one of the sensors. The invention also includes a master reset input device for selectively placing the control means in a normal mode wherein an activated alarm indicator remains activated independent of the condition of the sensors, and a master reset mode wherein the control means deactivates the alarm indicator whenever all of the sensors are deactivated.

The control means is also operative to selectively place the apparatus in an access mode preventing production of an alarm signal or a secure mode wherein activation of one or more sensors will result in the production of an alarm signal. The control means is responsive to an input signal to place the system in an autosecure mode in which the apparatus is immediately placed in a secure mode if none of the sensors are activated and is placed in the secure mode only when all sensors are inactive if one or more sensors are activated at the time of receipt of the autosecure signal. When the apparatus is in the autosecure mode, the control means returns the apparatus to the secure mode a predetermined time after the apparatus is placed in the access mode if none of the sensors are activated at that time or if the zone is disarmed. If one or more sensors was still activated at the expiration of the predetermined time period, the zone will be placed in the secure mode when all of the sensors become deactivated.

The accompanying drawings which are incorporated in and constitute a part of the specification, illustrate an embodiment of the invention and, together with the description, serve to explain the principles of the invention.

DESCRIPTION OF THE PREFERRED EMBODIMENT

Figure 1:
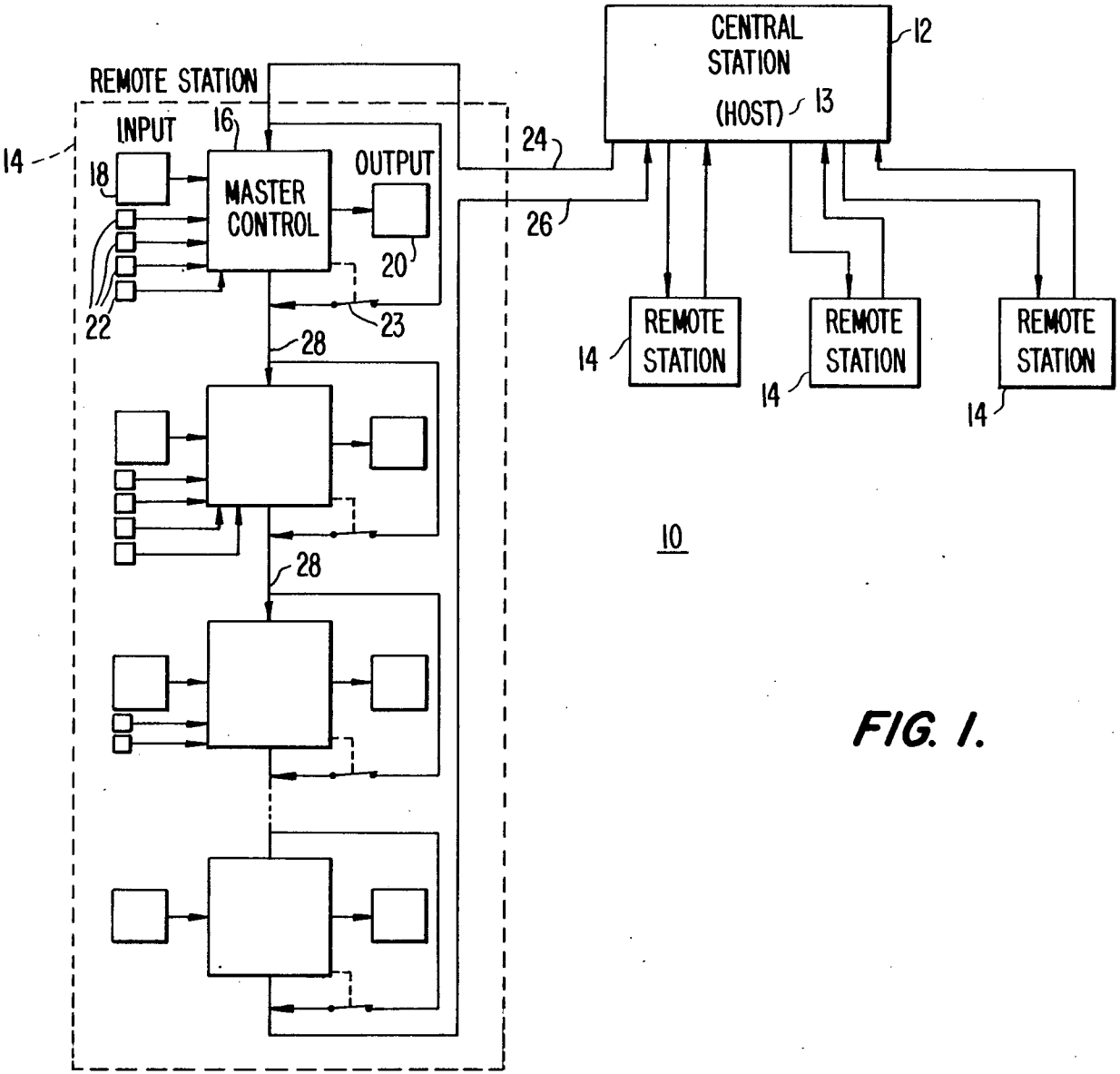
FIG. 1 is a general block diagram of access control and security alarm apparatus which constitutes one embodiment of the present invention.

Referring to the figures, like reference characters refer to corresponding elements. FIG. 1 shows an access control and security alarm system 10 which is a preferred embodiment of the present invention.

The physical apparatus in system 10 will first be described, followed by a description of the operation of the system. Finally, a detailed description will be provided of the logic embodied in instructions contained within microcomputer memory of each master control device 16.

Apparatus Description

The system 10 includes a central station 12 which has a host computer 13 serving as a central monitoring point for a plurality of remote stations 14. The remote stations 14 are typically in multiple-tenant residential or commercial buildings located remote from the central station 12. Each remote station 14 includes one or more master control devices 16 which provide access control and security alarm functions for up to thirty-two separate protection zones. Each master control device 16 has connected thereto a plurality of input devices 18 and a plurality of output devices 20. Furthermore, each master control device 16 may have up to four remotely operated access control systems 22 each consisting of an entry authorization device such as a numeric keypad or identification card reader, an electrically operated lock, a lock sense contact, and a door position indicator. These entry authorization devices are well known in the art. For example, numeric keypad entry stations may be a type 7023 obtainable in commercial quantities from the Corby Corporation and the identification card readers may be a type SAS-3 obtainable in commercial quantities from the Sensor Engineering Corporation. For convenience, the term "card reader" will be used instead of "entry authorization device" but it is to be understood that this term also includes numeric keypad entry authorization devices.

Each remote station 14 is connected to the central station 12 by means of a communication channel which in the preferred embodiment consists of a pair of telephone lines 24 and 26. The telephone line 24 transmits data from the central station to the first master control device 16 of the remote station 14. Each master control device 16 at the remote station is connected to the next master control device by a communication line 28 consisting of a single twisted pair line. The output of the last master control device at the remote station 14 is connected to and transmits data over the telephone line 26 to the central station.

A normally closed communication bypass relay 23 is connected in parallel with each master control device 16 on the communication lines 24, 26 and 28. When the associated master control device 16 is operated normally, the relays 23 are energized to an open-circuit position. However, if a failure should occur in the master control device 16, the relay 23 is deenergized to return to its closed position and shunt the inoperative master control device 16.

Each master control device 16 is conceptually separated into four reader interface modules (RIMs), each of which can have associated therewith a single remotely operated access control system 22. Each RIM can further have a maximum of 8 protection zones associated therewith. Thus, each master control device 16 can have up to four remotely operated access control systems 22 and thirty-two protection zones.

Figure 2:
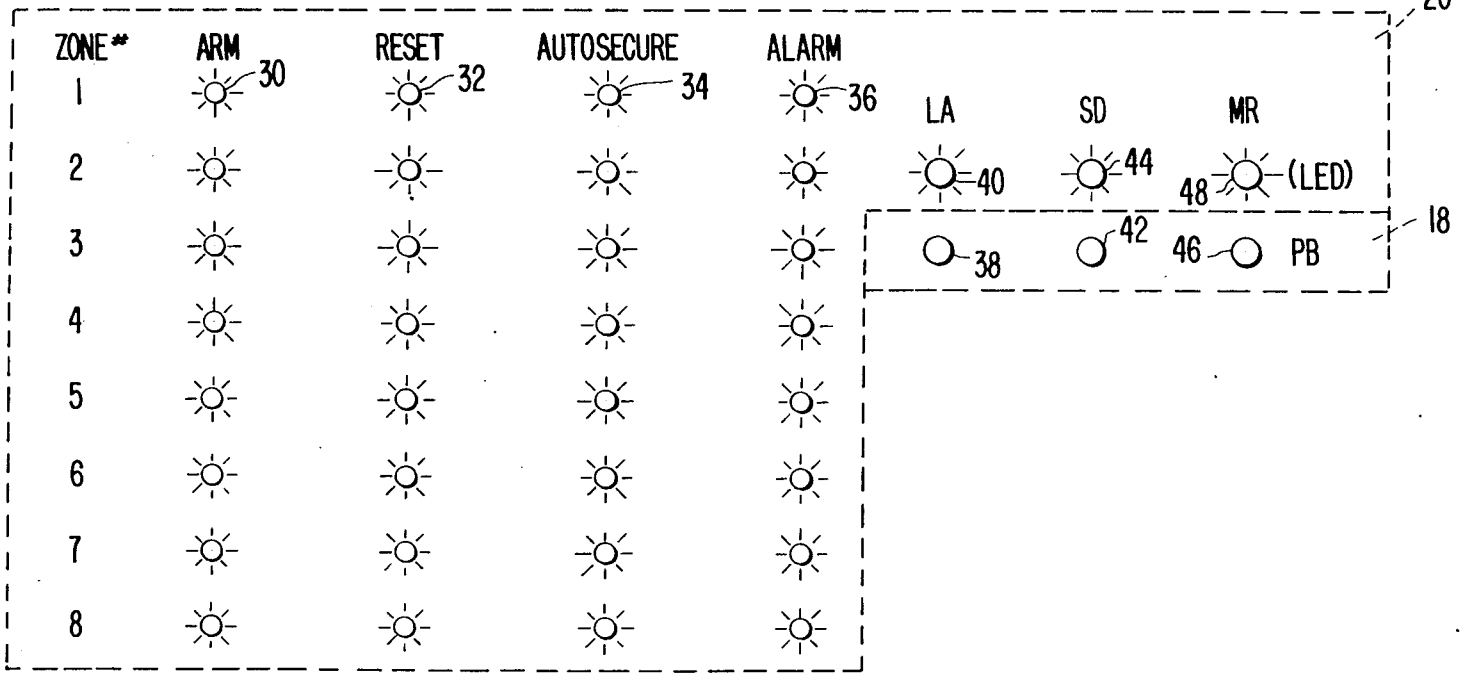
FIG. 2 is a pictorial diagram of input and output devices appearing on the panel of each master control device shown in FIG. 1.

FIG. 2 shows input and output devices 18 and 20 for each RIM appearing on the panel of each master control device 16. A plurality of arm LEDs 30 is provided, one for each zone. When the host computer 13 sends an arm signal to a specific zone of a remote station 14, the appropriate LED 30 will be energized. Similarly, reset, autosecure, and alarm LEDs 32, 34, 36, respectively, are also provided on the panel of each master control device 16.

The reset LEDs 32 for each zone are energized whenever the host computer transmits a reset signal to the specific zone. In addition, all reset LEDs 32 are energized whenever master reset is called for by personnel at the remote station 14. The autosecure LEDs 34 are energized for each zone to which the host 13 has transmitted an autosecure signal. The alarm LEDs 36 are energized for each zone in which an alarm signal has been generated as a result of activation of a sensor within that zone. Other output devices 20 include alarm indicators such as sirens or warning bells.

Also present on the panel of each master control device 16 is a local arm push-button 38, a local arm LED 40, a siren disable push-button 42, a siren disable LED 44, a master reset pushbutton 46, and a master reset LED 48. Security or maintenance personnel at the remote station 14 can provide a local arm signal for all zones at the remote station 14 in place of an arm signal supplied by the central station 12. Indication of such action is provided by energization of the local arm LED 40. Such personnel can also provide a siren disable function for various maintenance purposes by activating the siren disable push-button 42, an indication of which is provided by energization of the siren disable LED 44. Finally, personnel at the remote station 14 can also provide a master reset function for all zones controlled by the master control device 16 by operating the master reset push-button 46, an indication of which is provided by energization of the master reset LED 48.

Figure 3:
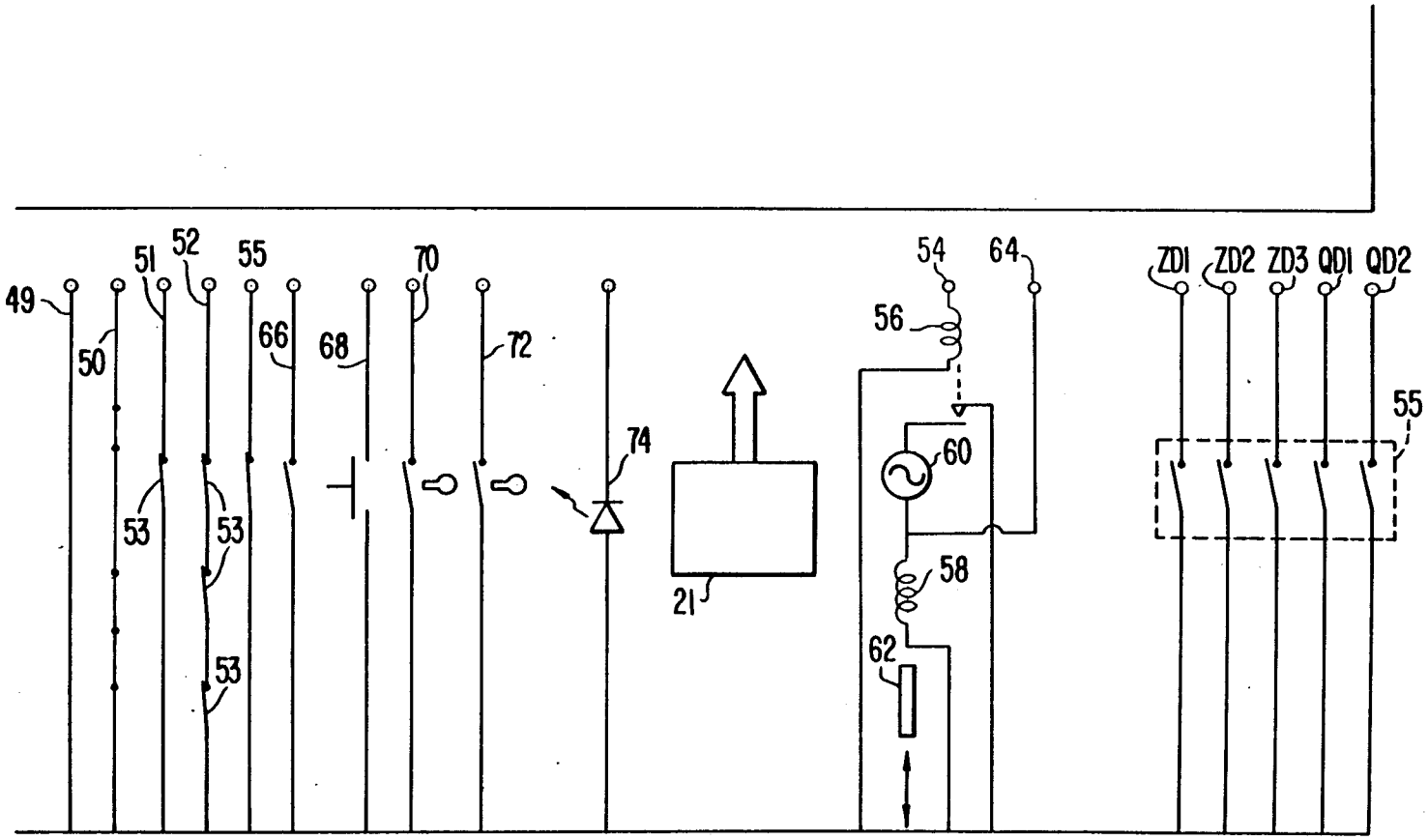
FIG. 3 is a schematic diagram of external input and output devices connected to each master control device shown in FIG. 1.

Referring now to FIG. 3, there is shown a schematic diagram of a terminal strip for a single RIM of a master control device 16 to which external input and output devices 18 and 20 are connected. A separate tamper loop 50 is connected for each zone to indicate unauthorized removal or alteration of equipment associated with the zone. As can be seen in FIG. 3, the tamper loop consists of a series circuit which extends through various components associated with the master control device 16 such as button switches located behind key-switch plates and on control instrument doors, and a tamper loop conductor running through all security cables.

A separate door loop 52 for each zone, each consisting of a plurality of sensors 53, is also connected to the terminals of the master control device 16. The sensors 53 can be any type of normally closed contact closure device known in the art which activates in response to occurrence of a specified condition. Typically, the sensors 53 consist of contacts which are closed when an associated entry device such as a door or window is also closed. When the associated entry device opens, the contacts of the sensor 53 also open. Other types of sensors 53 may also be included in the door loop such as floor pressure pads, ultrasonic motion detectors, and infrared detectors. Since the sensors 53 are connected in series, activation of any of the sensors will be detected as an open circuit in the door loop 52.

Door power terminals 54 are provided to control an electrically operated lock of a remotely operated access control system 22. Each master control device 16 can control up to four such systems 22, one for each RIM. As can be seen in FIG. 3, the door power terminals 54 are connected in series with the operating coil of a relay 56, the energization of which closes the contacts of the relay 56 to energize a solenoid 58 by a power source 60. The solenoid 58, in turn, operates a lock bolt 62 to either lock or unlock a door. Although the position of the bolt 62 can be either normally closed or normally open such that energization of the solenoid 58 results in either opening or closing, respectively, of the bolt 62, in the preferred embodiment, the bolt 62 is of the normally open type. Thus, energization of the solenoid 58 caused by activation of the door power terminal 54 will lock the associated door. In this manner, emergency conditions such as a power failure or fire will not be able to lock the door and possibly trap occupants of the protected zone. Also associated with the door power terminals 54 is a lock sense terminal 64. Lock sense terminal 64 detects the energization of the solenoid 58 to provide feedback to the master control device 16 of the activation of the door power terminals 54.

Further associated with the door power terminals 54 and lock sense terminal 64 is a door position indicator 66. The indicator 66 can be identical to sensors 53 to provide an indication of the position of the door associated with the electrically operated lock which is controlled and sensed by the terminals 54 and 64, respectively. Exit and entry switches 68 and 70, respectively, may be provided to enable users in a protected zone to operate the electric door lock. Although both the exit switch 68 and the entry switch 70 are contact closure devices, the exit switch 68 is a momentary contact push-button while the entry switch 70 is a mometary contact key-operated switch. Thus, the exit switch 68 can be operated by anyone, whereas the entry switch 70 is restricted to persons having possession of a key. The reason for this is that activation of the exit switch 68 serves only to unlock the electrically operated lock associated therewith, whereas activation of the entry switch 70 will result in reset of an existing alarm condition in a manner to be described more completely below.

A card reader 21 is also associated with the electrically operated lock, door power terminals 54, lock sense terminal 64, and door position indicator 66. Inputs from the card reader 21 to the master control device 16 include both data and control inputs in a manner well known in the art.

A key switch 72 is provided for each zone to enable a user to operate the zone between an access mode wherein activation of any of the sensors 53 will be ignored and a secure mode wherein activation of a sensor 53 will result in the generation of an alarm condition (assuming that the zone is armed by the central station 12). A secure light 74 is provided for each zone to indicate when the zone is in the secure mode.

A dual in-line package (DIP) switch 55 having five contacts is shown in FIG. 3. Four such switches 55 are located in the master control device 16, one for each RIM. Each switch 55 is used to set the value of logical variables ZD1, ZD2, ZD3, QD1, and QD2 for the associated RIM to specify to which of the 32 protective zones served by the master control device 16 each remotely operated access control system 22 is coupled.

Figures 4, 5:
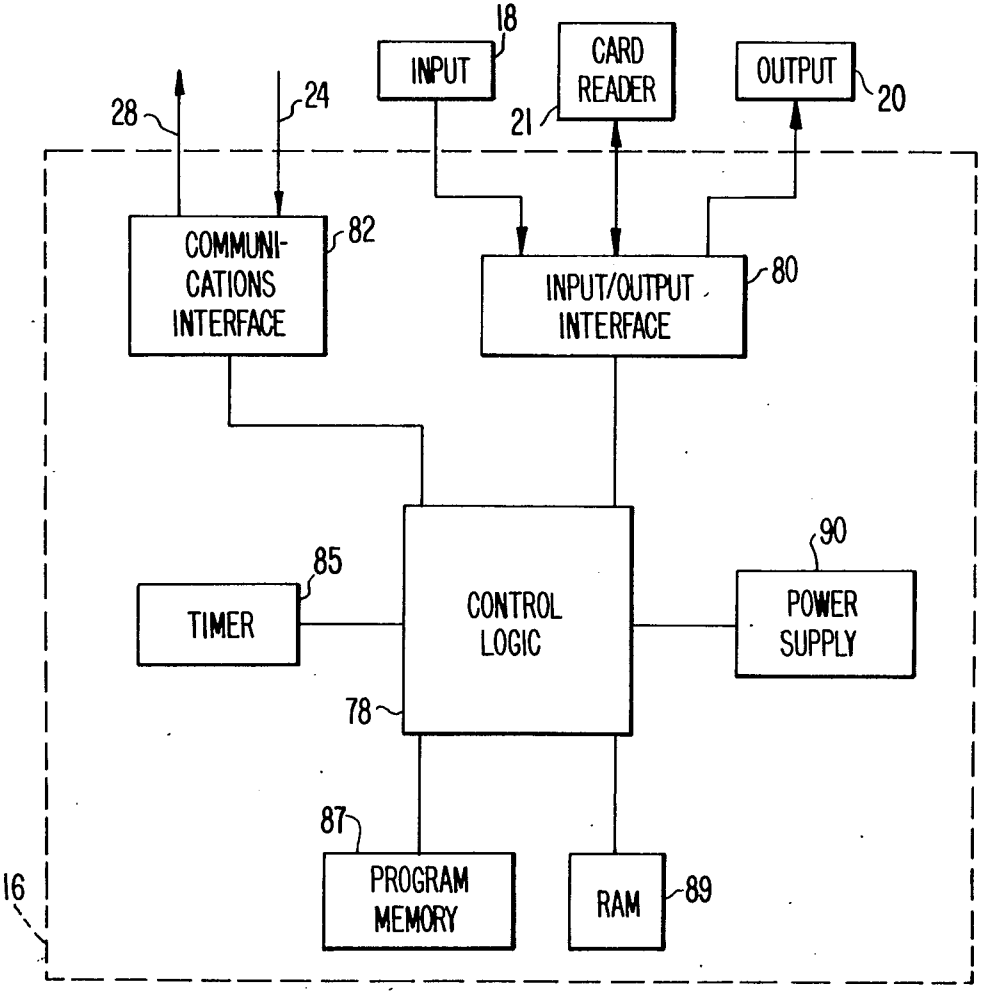
FIG. 4 is a block diagram of a master control device shown FIG. 1.
FIG. 5 is a diagram of memory locations contained in RAM memory shown in FIG. 4.

Referring now to FIG. 4, there is shown a schematic block diagram of the master control device 16. As can be seen therein, each master control device 16 includes control logic 78 which, in the preferred embodiment, comprises a microcomputer central processing unit such as a type 8085 obtainable in commercial quantities from the Intel Corporation. Connected between the control logic 78 and the input devices 18, output devices 20, and card readers 21 is an input/output interface circuit 80. Although the input/output interface circuit 80 is indicated as a single block, in the preferred embodiment, the actual function of the block 80 is performed by a plurality of buffer and driver circuits in a manner well known to those skilled in the art.

Connected between the control logic 78 and the input telephone line 24 and connecting line 28 is a communication interface 83 which, in the preferred embodiment, comprises a universal asynchronous receiver transmitter (UART). Also connected to the control logic 78 are a timer 85, program memory 87, RAM memory 89 and a power supply 90. The components 78, 80, 83, 85, 87, 89, and 90 of the master control device 16 are electrically connected in a conventional manner as is well known by those skilled in the art.

In accordance with the present invention, control means are provided for activating the alarm indicator upon activation of at least one of the sensors. As embodied herein, the control means comprises control logic 78, RAM memory 89, and program instructions contained in program memory 87.

The master control device 16 performs its function by analyzing the condition of logical input variables received from the host computer 13 of the central station 12 and from input devices 18 and by generating a plurality of logical output variables for transmission to the host computer 13 and the output devices 20. The status of the aforementioned logical variables is maintained in memory locations organized as storage buffers of RAM memory 88. A schematic diagram of these buffers is shown in FIG. 5. As can be seen therein, the buffers comprise a plurality of host input buffers 82, host output buffers 84, external input buffers 86, and external output buffers 88. A separate buffer 82, 84, 86 and 88 is provided for each of the four RIMs contained in each master control device 16. In addition, each of the buffers 82, 84, 86, and 88 includes a corresponding identical buffer 82*a*, 84*a*, 86*a* and 88*a* which is used to detect a change in condition of the contents of the buffers in a manner to be more completely described below.

Each of the buffers 82, 84, 86 and 88 has stored therein a plurality of values corresponding to the status of logical variables. Each of the buffers 82, 84, 86 and 88 includes a maximum of 48 logical variables organized in eight groups of six each. In many cases, the eight groups correspond to the eight protection zones which are associated with each RIM. The value of each logical variable is either "active" or "restored." The specific logical variables stored in the buffers 82, 84, 86 and 88 are shown in Tables I, II, III and IV, respectively.

The status of the logical variables of the external input buffer 86 represents the actual physical status of an input device 18. The manner in which the physical status (open circuit, closed circuit, presence of voltage, absence of voltage, etc.) is transferred to a logical variable is dependent upon the specific type of control logic 78 and input/output interface 80 which are provided. In any case, this process is well known to those skilled in the art and will not be described in detail. Similarly, the manner in which a logical variable in external output buffer 86 is used to operate a physical device such as a solenoid or siren is well known to those skilled in the art and will not be described in detail.

TABLE I

| GROUP | HOST INPUT BUFFER 82 POINT | | | | | |
|---|---|---|---|---|---|---|
| (ZONE) | 1 | 2 | 3 | 4 | 5 | 6 |
| 1 | PROP | ALARM1 | ACCESS1 | TAMPER1 | CONTACT1 | |
| 2 | | ALARM2 | ACCESS2 | TAMPER2 | CONTACT2 | |
| 3 | | ALARM3 | ACCESS3 | TAMPER3 | CONTACT3 | |
| 4 | | ALARM4 | ACCESS4 | TAMPER4 | CONTACT4 | AC POWER |
| 5 | LOCAL ARM | ALARM5 | ACCESS5 | TAMPER5 | CONTACT5 | BAT. SUPV |
| 6 | SIREN DISABLE | ALARM6 | ACCESS6 | TAMPER6 | CONTACT6 | GROUND |
| 7 | MASTER RESET | ALARM7 | ACCESS7 | TAMPER7 | CONTACT7 | BOX TAMPER |
| 8 | PERIM. PROP | ALARM8 | ACCESS8 | TAMPER8 | CONTACT8 | SIREN POWER |

These logical variables are transmitted to the host computer 13 to inform the host of the status of the input devices 18 connected to the master control device 16.
PROP - Activates 30 seconds after LOCK SENSE (defined in Table III) restores (bolt unlocks). Restores when LOCK SENSE activates.
LOCAL ARM - Toggles when LAPB (Table III) activates (push-button pressed) or toggles when LA OUTPUT activates.
SIREN DISABLE - Toggles when SDPB (Table III) or SD OUTPUT (Table II) activates.
MASTER RESET - Toggles when MRPB (Table III) or MR OUTPUT (Table II) activates.
PERIMETER PROP - Activates 30 seconds after PERIMETER LOOP (Table III) restores (door opens). Restores when PERIMETER LOOP activates.

TABLE II

| GROUP | HOST OUTPUT BUFFER 84 POINT | | | | | |
|---|---|---|---|---|---|---|
| (ZONE) | 1 | 2 | 3 | 4 | 5 | 6 |
| 1 | DOOR CTL | ARM1 | RESET1 | AUTOSECURE1 | | |
| 2 | | ARM2 | RESET2 | AUTOSECURE2 | | |
| 3 | | ARM3 | RESET3 | AUTOSECURE3 | | |
| 4 | | ARM4 | RESET4 | AUTOSECURE4 | | |
| 5 | LOCAL ARM OUT | ARM5 | RESET5 | AUTOSECURE5 | | |
| 6 | SIREN DISABLE OUT | ARM6 | RESET6 | AUTOSECURE6 | | |
| 7 | MASTER RESET OUT | ARM7 | RESET7 | AUTOSECURE7 | | |
| 8 | | ARM8 | RESET8 | AUTOSECURE8 | | |

These logical variables are transmitted to the master control device 16 from the host computer 13 and direct the master control device 16 to perform the designated actions with regard to the zones of the associated RIM and the associated output devices 20.
DOOR CTL - When activated, indicates that the electrically operated lock for this RIM is to be locked.
LA OUTPUT - When activated, indicates that the local arm LED 40 for this RIM is to be energized.
SD OUTPUT - When activated, indicates that the siren disable LED 44 for this RIM is to be energized.
MR OUTPUT - When activated, indicates that the master reset LED 48 for this RIM is to be energized.
ARMz (zone number) - When activated indicates that this zone number should be placed in the arm mode.
RESETz (zone number) - When activated, indicates that this zone number should be reset.
AUTOSECUREz (zone number) - When activated, indicates that this zone should be placed in autosecure mode.

TABLE III

| GROUP | EXTERNAL INPUT BUFFER 86 POINT | | | | | |
|---|---|---|---|---|---|---|
| (ZONE) | 1 | 2 | 3 | 4 | 5 | 6 |
| 1 | LOCKSENSE | DOOR LOOP 1 | TAMPER LOOP 1 | KEYSWITCH 1 | CTI1 | ZD1 |
| 2 | DOOR POS | DOOR LOOP 2 | TAMPER LOOP 2 | KEYSWITCH 2 | CTI2 | ZD2 |
| 3 | EXIT | DOOR LOOP 3 | TAMPER LOOP 3 | KEYSWITCH 3 | CTI3 | ZD3 |
| 4 | ENTRY | DOOR LOOP 4 | TAMPER LOOP 4 | KEYSWITCH 4 | CTI4 | (AC SENSE) QD1 |
| 5 | LOCAL ARM PB | DOOR LOOP 5 | TAMPER LOOP 5 | KEYSWITCH 5 | CTI5 | (BAT. CHG) QD2 |
| 6 | SIREN DISABLE PB | DOOR LOOP 6 | TAMPER LOOP 6 | KEYSWITCH 6 | CTI6 | GROUND DETECT |
| 7 | MASTER RESET PB | DOOR LOOP 7 | TAMPER LOOP 7 | KEYSWITCH 7 | CTI7 | BOX DOOR LOOP |

TABLE III-continued

| EXTERNAL INPUT BUFFER 86 | | | | | | |
|---|---|---|---|---|---|---|
| 8 | PERIM. LOOP | DOOR LOOP 8 | TAMPER LOOP 8 | KEYSWITCH 8 | CTI8 | SIREN POWER |

These logical variables represent status of signals received from input devices 18 for this RIM.
LOCK SENSE - When activated, indicates that power has been applied to solenoid 58 of the electrically operated lock for this RIM.
DOOR POS - This is the condition of sensor 66. When activated, indicates that the door associated with the electrically operated lock for this RIM is open.
EXIT - This is the status of exit switch 68 associated with the electrically operated lock for this RIM. When activated, indicates that the switch 68 closed.
ENTRY - When activated, indicates that the switch 70 is closed.
LAPB - When activated, indicates that the local arm push-button 38 for this RIM has been pressed.
SDPB - When activated, indicates that the siren disable push-button 42 for this RIM has been pressed.
MRPB - When activated, indicates that the master reset puch-button 46 for this RIM has been pressed.
PERIMETER LOOP - When activated, indicates that one of the sensors 53 of the parameter loop 51 has been activated.
DOOR LOOPz (zone number) - When activated, indicates that one of the sensors 53 of the door loop for this zone has been activated.
TAMPER LOOPz (zone number) - When activated, indicates that the series circuit of the tamper loop 50 for this zone has been broken.
KEYSWITCHz (zone number) - When activated, indicates that the keyswitch 72 has been activated to toggle this zone between access mode and secure mode.
CTIz (zone number) - When activated, indicates that an auxiliary contact input has been activated. This input is used for various miscellaneous purposes such as to provide access to a janitor's door.
ZD 1, ZD 2, ZD 3, QD 1, QD 2 - Each master control device 16 can handle up to four PIMs, and each RIM can serve a single remotely operated access control system and up to eight zones, providing a total capacity for each master control device 16 of 32 zones. The zone circuitry in the master control device 16 is provided on four 8-zone modules. The quantities QD 1 and QD 2 constitute a 2-bit number designating which of the four zone module boards contains the zone to which a remotely operated access control system for this RIM is interfaced. The quantities ZD 1–ZD 3 constitute a 3-bit number designating to which zone of the 8-zone module designated by QD 1–QD 2, the remotely operated access control system is interfaced.
AC SENSE - When activated, indicates that AC power is available.
BATTERY CHG - When active, indicates that the battery of power supply 90 is charging.
GROUND DETECT - When active, indicates that a ground fault has occurred on this RIM.
BOX DOOR LOOP - When active, indicates that the door to the mounting box for this master control device is open.
SIREN PWR MON - When active, indicates that no power is available to energize the siren for this RIM.

TABLE IV

| | EXTERNAL OUTPUT BUFFER 88 | | | | | |
|---|---|---|---|---|---|---|
| GROUP | POINT | | | | | |
| (ZONE) | 1 | 2 | 3 | 4 | 5 | 6 |
| 1 | DOOR PWR | SIREN1 | SECURE1 | ARM1 | RESET1 | AUTOSECURE1 |
| 2 | | SIREN2 | SECURE2 | ARM2 | RESET2 | AUTOSECURE2 |
| 3 | | SIREN3 | SECURE3 | ARM3 | RESET3 | AUTOSECURE3 |
| 4 | | SIREN4 | SECURE4 | ARM4 | RESET4 | AUTOSECURE4 |
| 5 | LOCAL ARM | SIREN5 | SECURE5 | ARM5 | RESET5 | AUTOSECURE5 |
| 6 | SIREN DISABLE | SIREN6 | SECURE6 | ARM6 | RESET6 | AUTOSECURE6 |
| 7 | MASTER RESET | SIREN7 | SECURE7 | ARM7 | RESET7 | AUTOSECURE7 |
| 8 | | SIREN8 | SECURE8 | ARM8 | RESET8 | AUTOSECURE8 |

These logical variables represent output control signals for the output devices 20 associated with this RIM.
DOOR PWR - Interrupts power to solenoid 56 when DOOR CTL is active.
LOCAL ARM - When active, energizes local arm LED 40.
SIREN DISABLE LED - SD LED 44 lights whenever SIREN DISABLE is active.
MASTER RESET LED - MR LED 48 lights whenever MASTER RESET is active.
SIRENz (zone number) - Active whenever ALARMz or TAMPERz is active and SIREN DISABLE is restored. Restores in 5 minutes or earlier if ALARM/TAMPERz restores - activates siren for this zone.
ACCESSz - Lights the access LED 74 on the keyplate for the zone. Active whenever ACCESSz is restored (zone in secure).
ARM LEDz - Arm LED 38 for this zone lights whenever zone is armed: ARMz active or LOCAL ARM active.
RESET LEDz - Reset LED 33 for this zone lights whenever RESETz is active or MASTER RESET is active.

Functional Description

The functional description of the system will now be provided from the point of view of a user. As stated previously, a remote station 14 is typically located at a multiple tenant building containing a number of apartments or office suites. The master control device 16 is typically located in a maintenance area or utility room to provide protection for the building in general and a plurality of separate office suites. The position of the main entrance door for the building is monitored by a sensor 53 (FIG. 3) connected in the perimeter loop 51. Normal entry and exit through this door will not result in any indication either locally or at the central station 12. However, if the main entrance door remains open for more than 30 seconds, this fact is transmitted to the central station 12 by activation of the PERIMETER PROP logical variable in the host input buffer 82. Opening of the door for more than 30 seconds is a condition of which the central station 12 should be aware, since it could conceivably represent a loss of access control.

When the tenants of the office suite leave the office at the end of the day, the doors are locked and the zone associated with the office suite switched to the secure mode by operation of the keyswitch 72. A light 74 usually located in close proximity to the keyswitch 72 to indicate secure mode is then lighted.

An alarm cannot yet be generated in the zone, however, since the zone has not yet been armed by a signal from the central station 12. This is to allow the suite to be cleaned at the end of the day. Cleaning personnel are provided with a key to the suite to permit them to enter to clean the premises. When cleaning is completed, a telephone call is placed to the central station 12 informing of this fact. The central station then sends an arm signal to the zone. When this signal is received, the zone is in condition to generate an alarm upon detection of an unauthorized entry. In the event that the telephone call is not placed to the central station 12 requesting that the zone be armed, personnel at the central station may follow a procedure in which the arm signal is sent at a specified time, regardless of whether a telephone request has been received.

With the zone both armed and secured, entry into the zone which activates any of the sensors 53 of the zone door loop will cause an alarm to be generated and transmitted to the central station, and will also cause the siren associated with the zone to sound. The siren will continue until the zone is reset by a signal from the central station 12. Alternatively, the siren can be silenced by switching the zone to access or by an authorized entry which activates the ENTRY logical variable for this RIM. Entry can be activated through the use of the keyswitch 72 or by use of a card reader 21 associated with this zone. It must be emphasized that not all zones have a card reader associated therewith. Each master control device 16 can handle a maximum of four card readers, whereas up to 32 zones may be protected by a single master control device.

In prior art systems, if entry is desired to a zone in both arm and secure modes, a user would activate the key switch 72 to return the zone to the access mode, to permit entry without generation of an alarm. It was then required that the zone be manually returned to the secure mode. Often, users would forget to return the zone to the secure mode, resulting in a lower level of security. The present invention provides increased convenience for the user as well as increased security by providing an autosecure mode.

In accordance with the invention, control means are provided which are connected to the sensors and to the alarm indicators for responding to control signals by placing a specific zone into an access mode preventing activation of the alarm indicator upon activation of the sensors or into a secure mode wherein activation of one or more sensors will result in activation of the alarm indicator. The control means is responsive to an autosecure control signal to place the master control device in the secure mode if none of the sensors are activated or, if one or more sensors are activated at the time of receipt of the autosecure control signal, to place the master control device in the secure mode when all sensors become inactive. The control means also includes means for placing the master control device in an autosecure mode upon receipt of the autosecure control signal and, when in the autosecure mode, for selecting the secure mode a predetermined time period after the master control device is placed in the access mode if none of the sensors are activated and for placing the master control device in the secure mode when all of the sensors become inactivated if at least one sensor was activated at the expiration of the predetermined time period.

As embodied herein, the aforementioned control means and placing means comprises the control logic 78, RAM memory buffers 84, 86, and 88, and instructions stored in program memory 87, as will be described in detail.

The control means also includes means responsive to an arm control signal from the central station for selectively placing each zone independently of every other zone into either an arm mode permitting generation of an alarm signal or a disarm mode preventing generation of an alarm signal. As embodied herein, such responsive means comprises control logic 78, RAM memory buffers 84, 86, and 88, and program instructions of memory 87 as shown in FIGS. 7B and 7C.

A specific zone may be placed in autosecure mode by the central station 12 by sending an autosecure signal to the remote station 14. This places the zone in the secure mode if no sensors 53 of the door loop 52 are active; that is, if all doors of the zone are closed or if the zone is not armed. If this is not the case, the zone will remain in the access mode until such time as all sensors 53 of the door loop 52 are restored or the zone is disarmed. At this time, the zone will be placed in the secure mode. If an authorized user desires entry at this time and activates the keyswitch 72 to return the zone to the access mode, such entry can be accomplished without the generation of an alarm. However, since the zone is in the autosecure mode, the zone, instead of remaining in the access mode until the keyswitch 72 is once again activated, is returned automatically to the secure mode after expiration of a 30 second delay period. In this manner, greater convenience is provided to the user with no loss in security to the zone. Furthermore, it is possible through the autosecure feature of the present invention to permit the central station 12 to place the zone in condition to generate an alarm without any action required from the users at the remote station.

The status of each zone is displayed on the panel for each RIM of the master control device 16. Thus, the status of arm, reset, autosecure, and alarm for each zone is displayed by the LED indicators 30, 32, 34 and 36. In addition, capability is provided to generate a local arm signal or a siren disable condition when desired. The local arm feature is used when the remote station 14 is no longer effectively communicating with the central station 12. Siren disable is generally used for maintenance purposes. The local arm, siren disable and master reset features are global to all four RIMs of the master control device.

In accordance with the invention, the above-mentioned control means includes means for discontinuing a produced alarm signal whenever the control means is in the master reset mode and the alarm loop is sensed to be a closed circuit. As embodied herein, the discontinuing means comprises control logic 78, RAM memory buffers 84, 86, and 88, and program instructions contained in program memory 87; and specifically, program instructions containing the logic expressed in FIG. 7C to be described below.

The master reset feature provides simpler and cheaper testing of the system, both at installation and during periodic maintenance, and is initiated by placing the master control device into the master reset mode by activating the master reset push-button 46. This condition is sensed by the master control device 16 and transmitted to the central station 12. The master reset indicator LED 48 is also energized. Next, the zones of the RIM which are desired to be tested are armed through either an arm command from the central station 12 or a local arm command generated by activating the local arm push-button 38. The zone is also placed in the secure mode either through operation of the keyswitch 72 or generation of an autosecure command from the central station 12. At this time, activation of any sensor 53 in the door loop 52 of the specified zone will result in an alarm. However, the alarm will be immediately reset when the specified sensor 53 is restored. In this manner, a single person can physically test each sensor 53 by opening the door associated therewith. If the entire system including the sensor 53 is operating properly, the siren will sound. The maintenance person will then close the door, causing a reset of the alarm condition which, in turn, causes the siren to become silent. Each sensor 53 of the door loop 52 of the specified zone can thus be easily tested without the necessity for performing a normal reset.

In accordance with the present invention, means are provided for selectively coupling the remotely operated access control system with any of the zones such that opening of an associated door causes the control means to activate the alarm indicator associated with the coupled zone. As embodied herein, the coupling means comprises control logic 78, RAM memory buffer 86, program instructions of memory 87, means fixedly associated with the remotely operated access control system for storing a value uniquely identifying one of the zones, and means for generating an electrical signal to the control means corresponding to the stored value. Specifically, the storing and generating means comprises DIP switches 55.

Figure 6A:
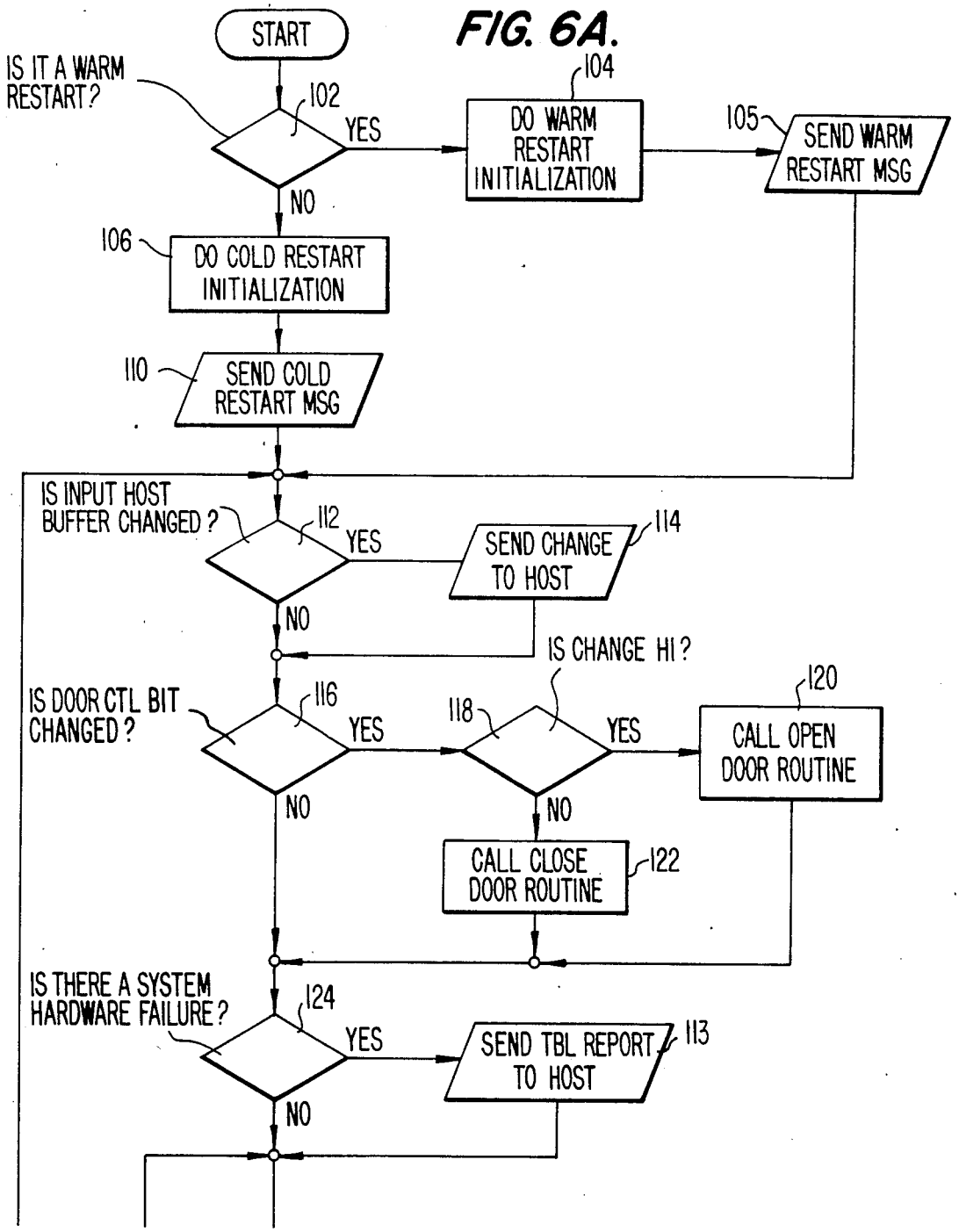
FIGS. 6 through 10 are flow charts describing the logic of programs stored in the program memory shown in FIG. 4.

Further in accordance with the invention, the control means comprises means for storing in storage locations of RAM memory buffer 86 a quantity representative of the specific zone to which the remotely operated access control systems associated with these storage locations is coupled. As embodied herein, such storing means comprises control logic 78, and program instructions of memory 87 as described in FIG. 6A which, upon a cold restart, store values from switches 55 in those locations of buffer 86 designated to hold variables QD1, QD2, 2D1, 2D2, and ZD3.

As described previously, each remotely operated access control system 22 has associated therewith a five-position DIP switch 55, each position of which establishes a separate one of the logical variables QD1, QD2, ZD1, ZD2, and ZD3. Switch 55 thus specifies to which protective zone the remotely operated access control system 22 will be coupled. If it is desired to change the zone to which such a system 22 is coupled, the switch contacts for variables QD1, QD2, are set to specify which of the four zone modules contains the desired zone and the switch contacts for variables ZD1, ZD2, and ZD3 are set to specify which of the eight zones on the selected module is desired. An open switch contact corresponds to an active value of the associated logical variable and a closed contact corresponds to a restored value. The values of QD1, QD2, ZD1, ZD2, and ZD3 are read into RAM upon execution of a cold restart.

Description of the Control Logic

In order to carry out the functions described above, each master control device 16 includes a plurality of instructions stored in program memory 87. The logic embodied in the instructions contained in program memory 87 will now be described with reference to the logic flow diagrams in FIGS. 6 through 10. In these figures, an electrically locked door is sometimes referred to as an "auto-door".

FIGS. 6A–6D is a logic flow diagram of the main loop program. This program is continuously executed so long as power is supplied to the master control device 16. After starting the program, a determination is made at block 102 if this is a "warm restart." If so, a warm restart is performed at block 104 wherein the RAM memory 88 is checked for consistency and no values are changed. A message is sent at block 105 to the host computer 13 indicating the warm restart. If a "cold restart" is called for, the cold restart initialization is performed at block 106 to set all zones to access, to restore all ARMz, RESETz, and AUTOSECUREz logical variables, and to load values of ZD1, ZD2, ZD3, QD1, and QD2 from associated DIP switches 55. A cold restart message is then sent to the host computer 13, as indicated in block 110.

A determination is made at block 112 if the host input buffer 82 is changed. The host input buffer contains the latest value of logical variables as stored therein by the master control device 16 due to conditions at the remote station 14. The status of these logical variables as they were last transmitted to the host computer 13 stored in the counterpart buffer **82*a*. Thus, a comparison of the buffers 82 and 82*a* determines if a change has occurred to the buffer 82*a* since the last time the status of the associated logical variables was transmitted to the host. If a change has occurred, then the new values are transmitted at block 114 to the host computer 13 and the updated values written into the counterpart buffer 8*a***.

At block 116, a determination is made as to whether the logical variable DOOR CTL of the host output buffer 84 has changed since the last time the main loop program for this RIM executed. This is determined by comparing the status of DOOR CTL in buffer **8*a* with its value in the counterpart buffer 84A. If a change has occurred, a determination is made at block 118 as to whether the change was from restored to active. If so, this is an indication that the host computer 13 has commanded the electrically locked door associated with this RIM to be opened. If so, the Door Open routine is called at block 120. If the change of DOOR CTL was from active to restored, the Door Close routine is called at block 122**.

A determination is made at block 124 as to whether a system hardware failure has occurred. If so, a trouble report is sent to the host computer 13 at block 126.

The main loop program continues in FIG. 6B where a determination is made at block 126 as to whether a module is present. In a preferred embodiment, the circuitry of the control device 16 is organized such that four RIMs are present to enable control of up to four remotely operated access control systems 22. Protection zone circuitry is contained on up to four zone board modules which each contain circuitry for eight protection zones. Other types of modules which can be provided in the control device 16 include auxiliary reader boards, input/output boards, supervisory boards, and an analog input board.

At block 128 a determination is made as to whether a zone board is present. If not, a series of checks for the presence of various other types of modules is made. If a zone board is present, the Zone Board routine is called at block 130. After execution of the Zone Board routine (described in greater detail in FIG. 7) a determination is made at block 132 as to whether any of the push-buttons 38, 42, or 46 have been pressed. If so, it is determined at block 134 if the MASTER RESET logical variable stored in host buffer 82 has changed state. If so, the master reset indicator LED 48 is changed to the appropriate state at block 136. This change is reported to the host at block 138. In a similar manner, it is determined at blocks 140 and 146 if the SIREN DISABLE logical variable or LOCAL ARM logical variables, respectively, in the buffer 82 have changed state. If so, appropriate indicator LEDs 44 and 40 are placed in the proper state at blocks 142 and 148, respectively, and these actions reported to the host computer at block 144 and 148, respectively 13.

If a zone board is not present as determined at block 128, similar checks and subroutine calls are made at blocks 128*a*–128*d* and 130*a*–130*d* for auxiliary reader boards, I/O boards, supervisory boards, and analog boards.

At block 152, it is determined if the variables associated with a remotely operated access control system 22 have changed state. This is determined by comparing the appropriate variables in the external input buffer 86 with the status of these variables during the previous execution of the main loop program by reference to counterpart buffer 86*a*. If so, a determination is made at block 154 if the LOCK SENSE variable has changed state. If so, it is checked whether the change was from restored to active at block 156. If yes, a 30-second door prop timer is set running at block 158. This timer is provided such that normal opening and closing of the door will not be interpreted as an abnormal condition and will not be reported to the host computer 13, thus reducing congestion of the communication lines 26 and 28. If the change was from active to restore, the door prop timer is turned off at block 160 (FIG. 6C).

Figure 6C:
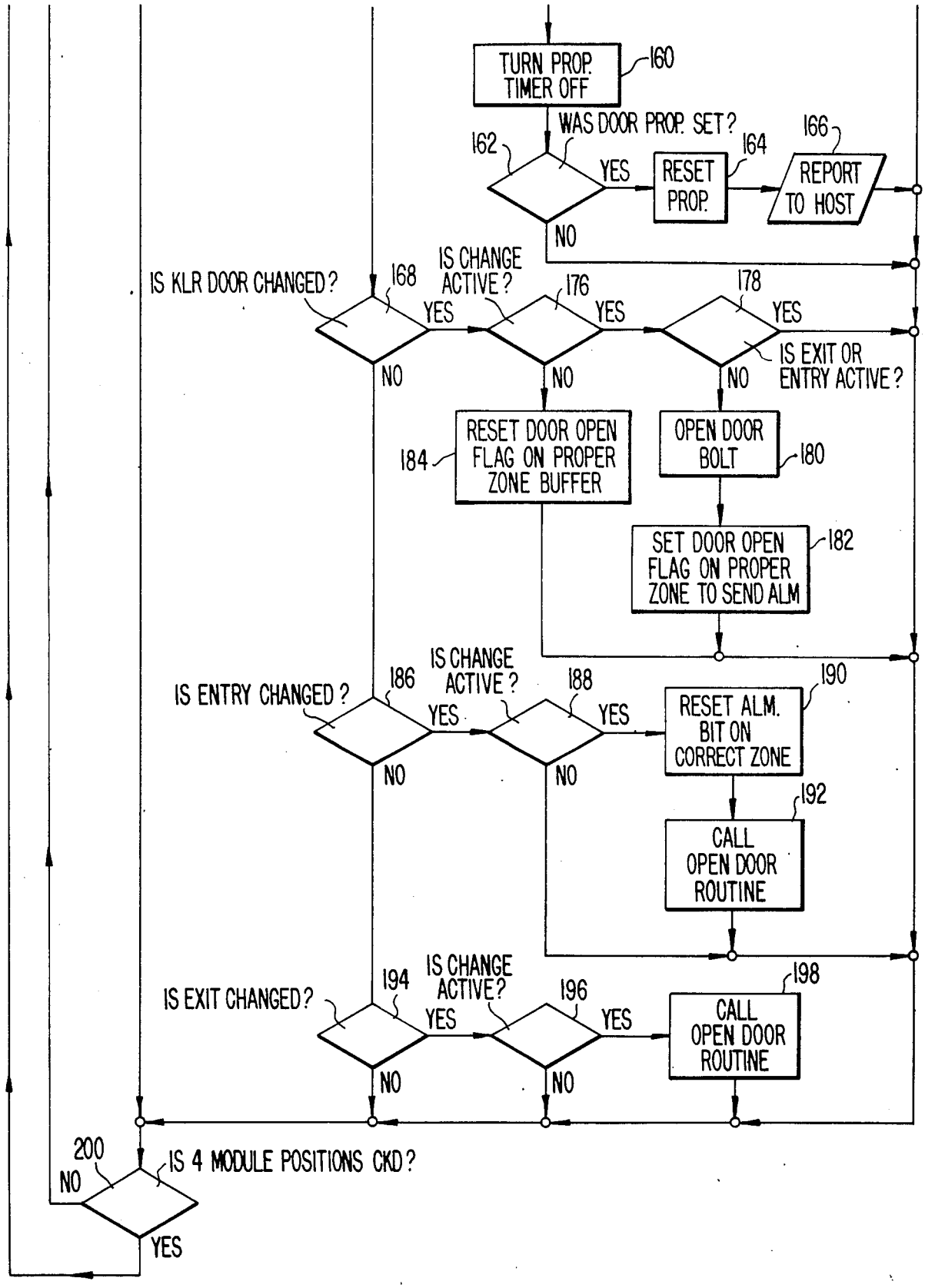

Continuing to FIG. 6C, it is determined at block 162 if the DOOR PROP variable in the host input buffer 82 is set. If so, this variable is reset at block 164 and the change reported to the host computer 13 at block 166.

If the LOCK SENSE variable was not changed at block 154, a determination is made at block 168 if the DOOR POS variable (referred to in the Figures as KLR door) in buffer 86 has changed, that is, has the position of the electrically locked door changed. If so, and if the change was from restored to active as determined at block 170, it is determined at block 178 whether the door timer is running. If the timer is running, this is an indication that the electrically locked door associated with this RIM was properly opened in response to an entry or exit request. If not, this is an indication of unauthorized opening of the electrically locked door. A command is generated at block 180 to open the bolt of the electrically locked door to limit damage which could occur due to a break-in. That is, the variable DOOR CTL in buffer 84 is activated. An actual alarm signal is not generated at this time, since all alarm signals are produced in the Zone Board routine of FIGS. 7A–7D. However, at block 182 a door open flag on the zone associated with the electrically operated locked door for this RIM is set to indicate an illegal entry.

If the change in the DOOR POS variable was from active to restored, the door open flag of the appropriate zone is reset at block 184.

If the DOOR POS variable has not changed, it is determined if the ENTRY variable changed at block 186. If so, and if the change was from restored to active as determined at block 188, then the alarm bit on the zone associated with the electrically locked door for this RIM is reset at block 190 and the door open routine called at block 192.

If the ENTRY value has not changed, it is determined at block 194 if the EXIT value has changed. If so, and if the change was from restore to active as determined at block 196, the door open routine is called at block 198. Note that an EXIT will not result in a reset of an alarm at the associated zone.

If no push-button has changed state on this RIM, it is determined at block 200 if all four positions in which a zone module board could be inserted have been checked. If not, the program executes the steps at blocks 126 through 198 for each of the remaining module positions. If all the module positions have been checked, the Main Loop program returns to block 112 for the next execution cycle.

Figure 6D:
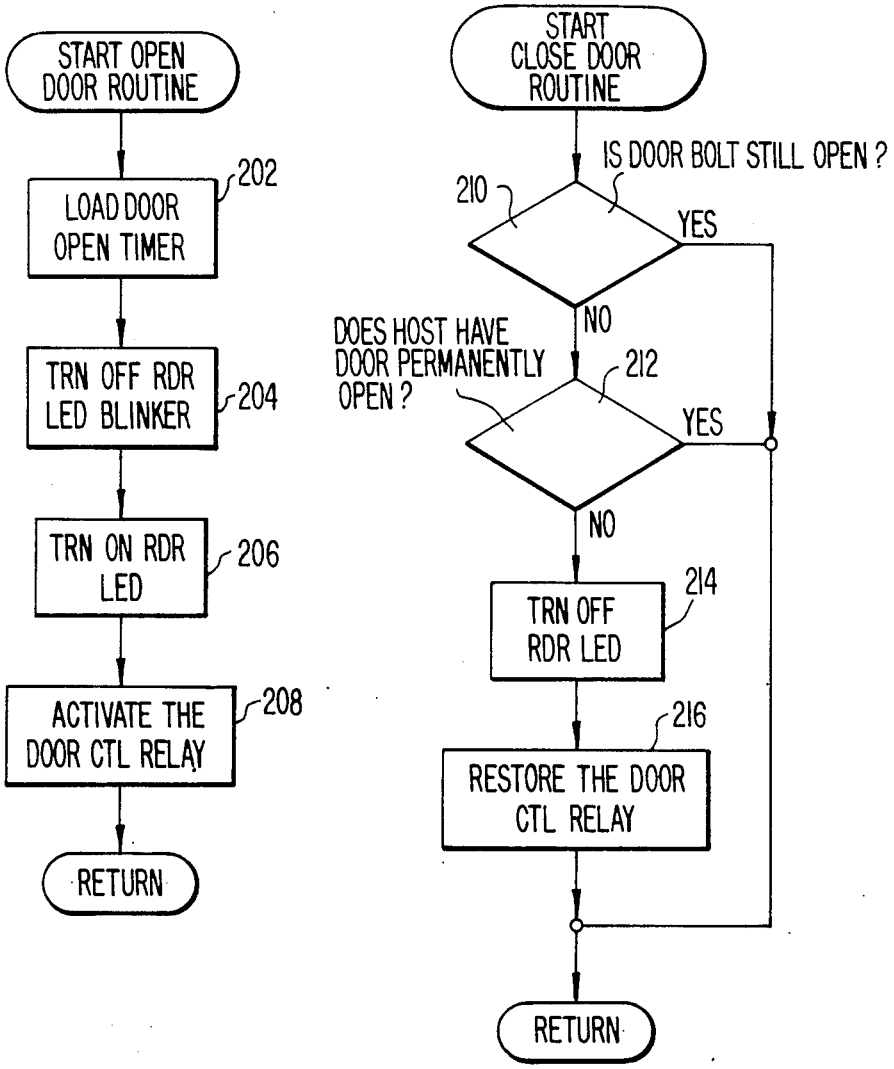

The Door Open and Door Close routines are shown in FIG. 6D. In the Door Open routine, a door open timer is set running at block 202. Next at block 204, a blinking LED on the card reader through which the entry request was generated is turned off. At block 206, the card reader LED is steadily energized. This indicates to a person requesting entry that the identification number on his card has been approved and the electrically operated lock is being unlocked. The logical variable DOOR PWR of the buffer 88 is then activated which removes power from the relay 56 of the electrically operated door to allow the door bolt 62 to return to the unlocked condition. At this point, the door can be opened by the person desiring entry.

In the Door Close routine, the logical variable LOCK SENSE is checked at block 210 to determine if the power is still being withheld and that the bolt 62 is still in the unlocked condition. If so, the Door Close routine is exited. If LOCK SENSE is active, it is determined at block 212 whether the host computer 13 has this door permanently opened. If this is the case, the Door Close routine is exited. If not, the LED on the associated card reader is turned off at block 214, and the DOOR PWR logical variable is restored at block 216 to cause power to be applied to the relay 56 and switch the bolt 62 to the locked position.

Figure 7A:
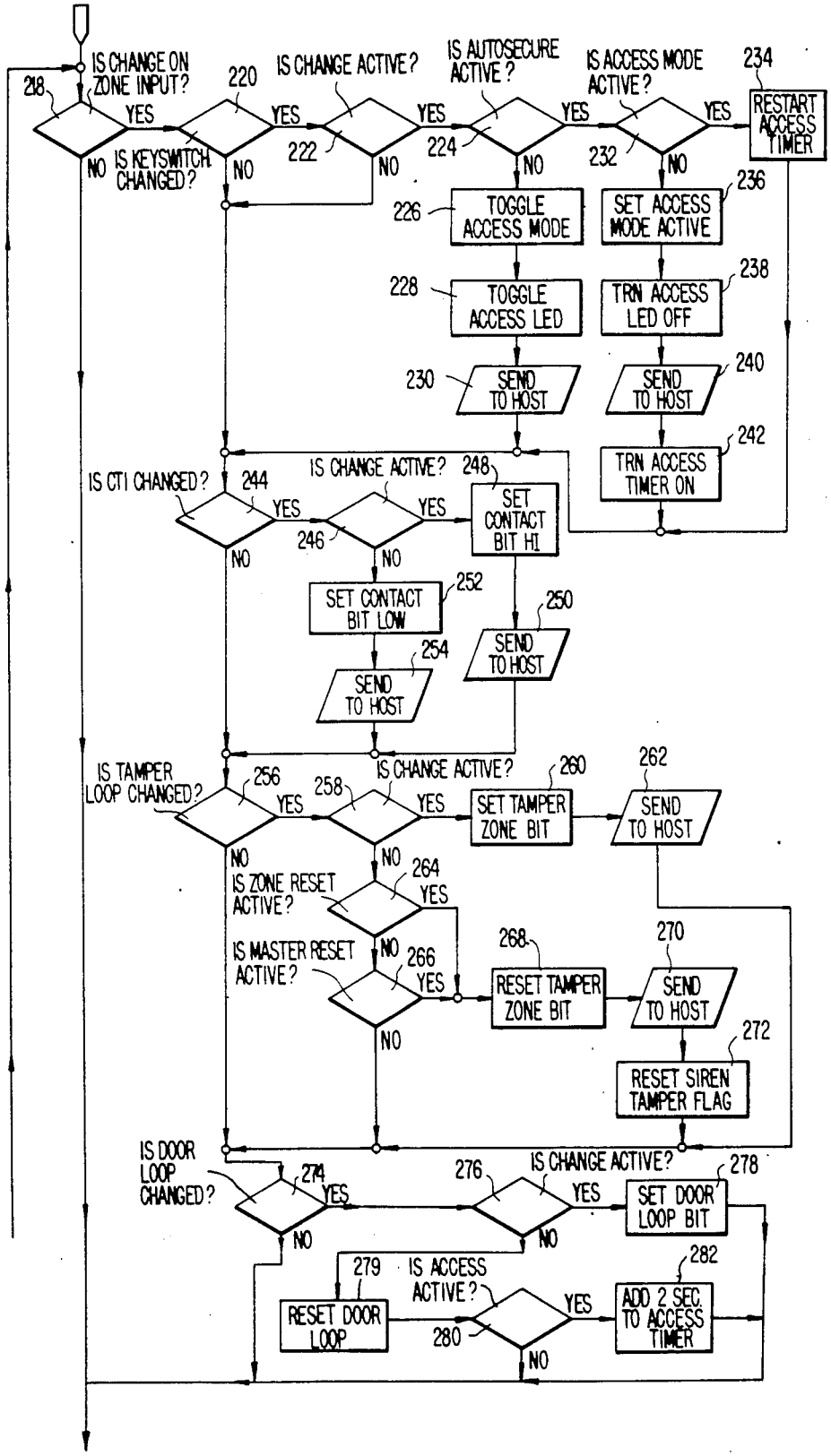
Figure 7B:
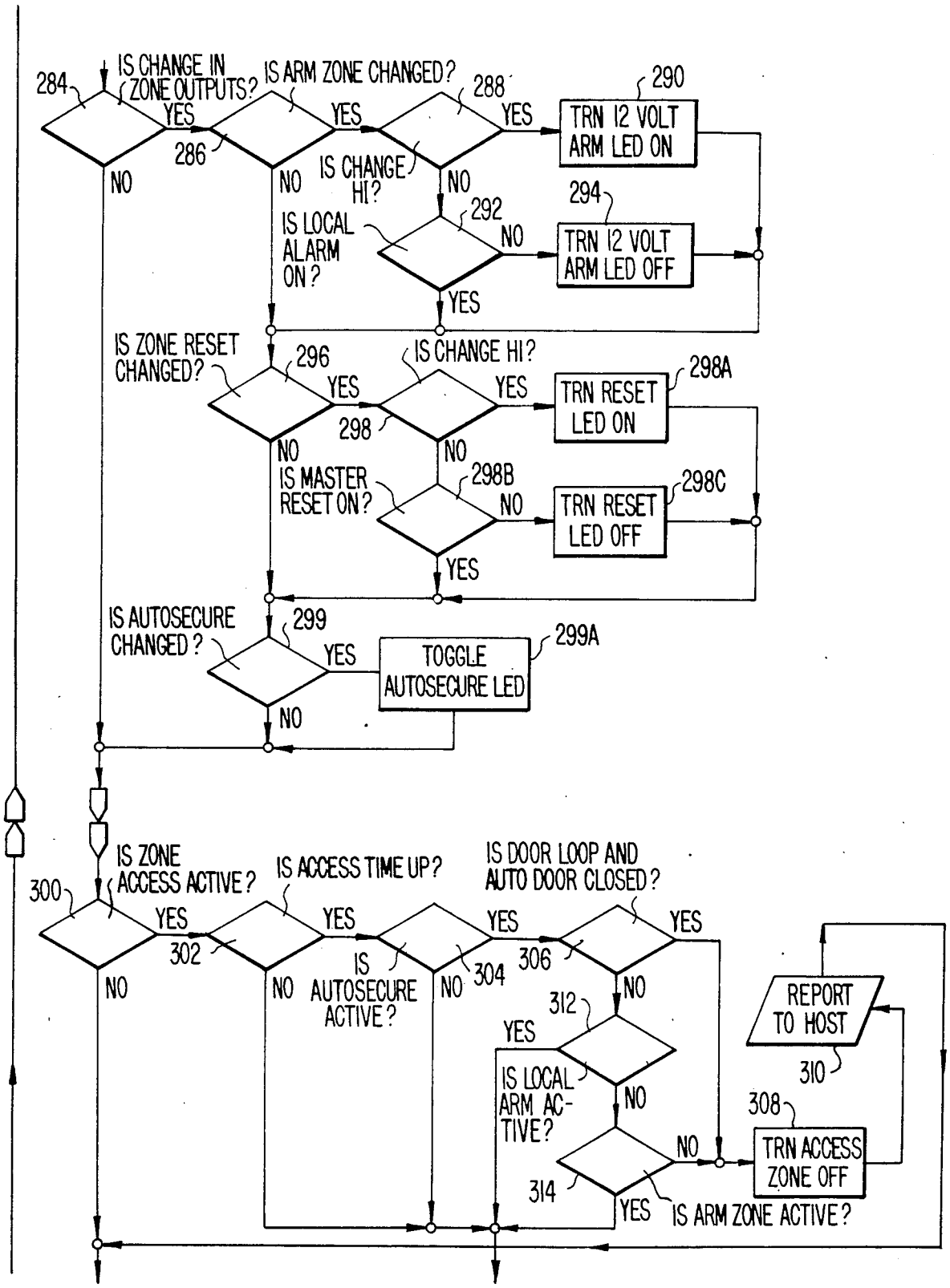
Figure 7C:
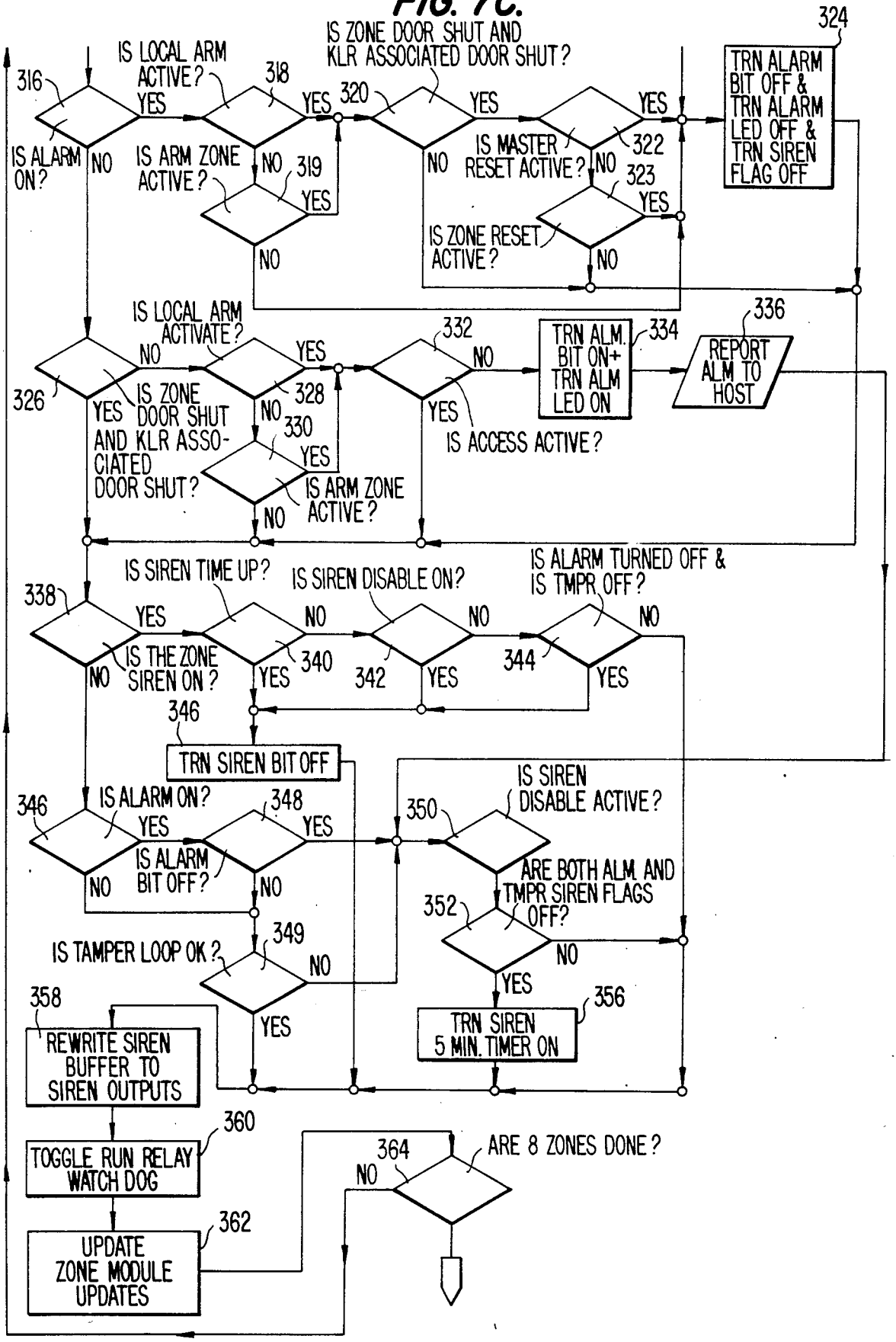

The logic flow diagram of the Zone Board routine is shown beginning on FIG. 7A. At block 218, it is determined whether there has been a change in the external input buffer 86 indicating that one of the input devices 18 has changed state since the last time the Zone Board routine was executed. If so, it is determined at block 220 whether the logical variable KEYSWITCH has changed, indicating that the access or secure status of the zone has changed. If so, and if the change was from restored to active as determined at block 222, this indicates that the zone has been changed from the access mode to the secure mode. If so, it is determined at block 224 if the zone is in the autosecure condition, by checking the AUTOSECURE logical variable for the associated zone in host output buffer 84. If not, the access-secure mode of this zone is toggled at block 226, the ACCESS variable of host input buffer 82 is toggled, the SECURE variable of the external output buffer 88 is toggled at block 228 to change the status of the secure light 74 at the zone, and the change in status of the access-secure mode is sent to the host computer at block 230.

If AUTOSECURE is active, a determination is made at block 232 if the access mode is active, as determined by the ACCESS variable of host input buffer 82. If so, the access timer is restarted at block 234 to provide a full time delay period from the time the user has last activated the keyswitch 72 until the status of the zone is automatically switched to the secure mode. If the access mode is not active, then the ACCESS variable is set active in host input buffer 82 at block 236 and the SECURE lamp 74 turned off at block 238. The change is then sent to the host computer 13 at block 240 and the access timer turned on at block 242.

Next, it is determined at block 244 whether the CTI contact, associated with an auxiliary contact of, for example, a janitor's door, has changed. If so, and if the change was from restored to active as determined by block 246, then the CONTACT variable for this zone in host input buffer 82 is set and the result transmitted to the host computer 13 at block 250. If the change in the CTI variable was from active to restored, then the CONTACT variable for this zone is restored in the host input buffer 82 at block 252 and the result transmitted to the host computer 13 at block 254.

It is determined at block 256 whether the tamper loop 50 of this zone has changed; that is, if the logical variable TAMPER LOOP for this zone in input buffer 86 has changed. If so, and if the change is from restored to active as determined by block 258, the TAMPER variable is set in host input buffer 82 at block 260 and the result transmitted to the host at block 262. If the change in the variable TAMPER LOOP is from active to restored, it is determined at blocks 264 and 266 whether the RESET variable of host output buffer 84 or the MASTER RESET variable of host input buffer 82 are active. If either of these variables is active, this indicates that a reset has indeed been called for, and the TAMPER variable for this zone is stored in host input buffer 82 at block 268. The result is transmitted to the host at block 270 and the siren tamper flag reset at block 272. The siren tamper flag will be utilized by the routine in block 352 of FIG. 7C. Next, it is determined at block 274 whether the door loop 52 for this zone has changed, that is, if the DOOR LOOP variable of external input buffer 84 has changed from the previous execution of this routine. If so, and if the change is active as determined by block 276, the door loop bit is set on in block 278.

If the change in DOOR LOOP variable is not active, the door loop bit is reset at block 279. At block 280, it is then determined whether the ACCESS variable for the zone in the host input buffer 82 is active. If so, two seconds are added to the access timer at block 282. The access timer is used to keep track of the 30-second autosecure time period. In block 282, the time period is extended by 2 seconds when the door loop closes in order to delay (by 2 seconds) the switching of the zone back to secure mode.

Referring to FIG. 7B, the zone board routine continues at block 284 where it is determined whether there has been a change in host output buffer 84 since the last time the zone board routine executed. If so, it is determined at block 286 if the ARM variable for this zone has changed, and if the change is active as determined at block 288, the ARM variable for the zone in the external output buffer 88 is activated to turn on the ARM LED 30 for the zone and to turn off a 12 volt utility contact.

At block 292 it is determined if this RIM is in the local arm condition as determined by the LOCAL ARM variable of host input buffer 82. If not, the ARM variable for this zone in external output buffer 88 is restored and the arm LED 30 for this zone is extinguished at block 294.

It is determined at block 296 whether the RESET variable in the external output buffer 88 has changed and, if the change is from restored to active as determined by block 298, the reset LED 32 for this zone is energized at block 298A. If the change, as determined by block 298, is from active to restore, it is determined at block 298B whether the MASTER RESET variable of external output buffer 88 is active. If not, the master reset LED 48 is extinguished. Finally, at block 299 it is determined whether the AUTOSECURE variable in external output buffer 88 for this zone has changed. If so, the autosecure LED 34 for this zone is toggled at block 299A.

At block 300, it is determined whether the ACCESS variable for this zone in host input buffer 82 is active. The access timer is checked at block 302 and if it has expired, a determination is made at block 304 if the AUTOSECURE variable for this zone in host output buffer 84 is active. If so, it is determined if the DOOR LOOP and DOOR POS in external input buffer 86 are both active, indicating that all doors and the electrically locked door for the zone are all in a closed position. If so, the ACCESS variable in host input buffer 82 and the ACCESS LED variable in external output buffer 88 are restored at block 308. The host input buffer 82 is then transmitted to the host at block 310. At this point, the zone has automatically been placed in the secure mode without any interaction by the user, following expiration of the predetermined time period after the zone was placed into the access mode.

If any of the doors of the zone including the electrically locked door are open as determined at block 306 following expiration of the access time period, a determination is made at block 312 and block 314 if either the LOCAL ARM variable for this RIM in host input buffer 82 or the ARM variable for the zone in host output buffer 84 are restored. If both of these variables are restored, then the zone is automatically placed in the secure mode at blocks 308 and 310. The operations of blocks 308 and 310 are not performed if either the LOCAL ARM or ARM variables are active.

Referring now to FIG. 7C, it is determined at block 316 whether the ALARM variable for this zone in host input buffer 82 is active. If so, and if the LOCAL ARM variable for this RIM in host input buffer 82 is active as determined at block 318, a determination is made at block 320 if the DOOR LOOP variable for this zone is restored and the door flag is off; that is, if all doors in this zone, including the electrically locked door, if present, are closed. If this is the case, a determination is made at block 322 if the MASTER RESET variable in host input buffer 82 is active. If so, at block 324 the ALARM variable for this zone is restored, the alarm LED 36 for this zone is turned off and the siren flag is turned off. If the MASTER RESET variable is not active, it is determined at block 323 if zone reset is active. If so, the functions of block 324 are executed.

If any of the doors of this zone including the electrically locked door are open, as determined at block 326 (referenced in FIG. 6C at block 182) by checking the DOOR LOOP variable for this zone and the door open flag, it is determined if either the LOCAL ARM variable for this RIM or ARM variable for this zone are active at blocks 328 and 330, respectively. If so, it is determined at block 332 if the ACCESS variable for this zone in this host input buffer 82 is active. If not, this means that the zone is both armed and secured and an unauthorized opening of the door has taken place. Accordingly, at block 334, the ALARM variable in host input buffer 82 is activated and the ALARM LED 36 for this zone is turned on. These actions are reported to the host at block 336 and the program advanced to block 350.

If all doors for the zone are closed, a determination is made at block 338 of whether the siren for this zone is on; that is, if the SIREN variable of external output buffer is active. If so, determinations are made at blocks 340, 342, and 344 whether either the siren time is up, the SIREN DISABLE variable for this zone is active, or both ALARM and TAMPER variables for this zone in host input buffer 82 are off. If any of these conditions of blocks 340, 342 and 344 are present, the SIREN variable of external output buffer 88 is turned off at block 346. Otherwise, the program advances to block 358 of FIG. 7C. If the SIREN variable is not active as determined by block 338, it is determined in block 346 whether the ALARM variable of host input buffer 82 for this zone is active. If so, and if the alarm bit (blocks 324, 334) is off, as determined in block 348, then a determination is made at block 350 if the SIREN DISABLE variable for this RIM in host input buffer 82 is active. If not, and if both the alarm and tamper siren flags are off, then the siren 5-minute timer is turned on at block 356 and the SIREN variable of external output buffer 88 is activated.

Next, at block 358 of FIG. 7C the SIREN variables for all zones are applied to the actual siren output terminals to sound the sirens for those zones in which the siren variable is active. A watchdog timer is then toggled at block 360 to indicate that the zone board routine has successfully executed. If a problem should develop in the zone board routine and this timer does not get toggled at the expiration of a predetermined time, a signal would be generated and transmitted to the host computer 13 indicating trouble on the zone board. At block 362, all of the variables of the external output buffer 88 are applied to the actual output terminals to appropriately control the output devices 18 connected thereto. At block 364, a determination is made as to whether the zone board routine has been executed for all eight zones associated with this RIM. If not, the routine is executed for the remaining zones of the RIM. If so, the routine is exited.

The Main Loop routine, including the zone board routine, executes continuously in the master control device 16 unless interrupted by a higher priority routine. Routines which execute on an interrupt basis include the Timer Interrupt routine, the Communication Interrupt routine, and the Card Reader Interrupt routine.

Figure 8A:
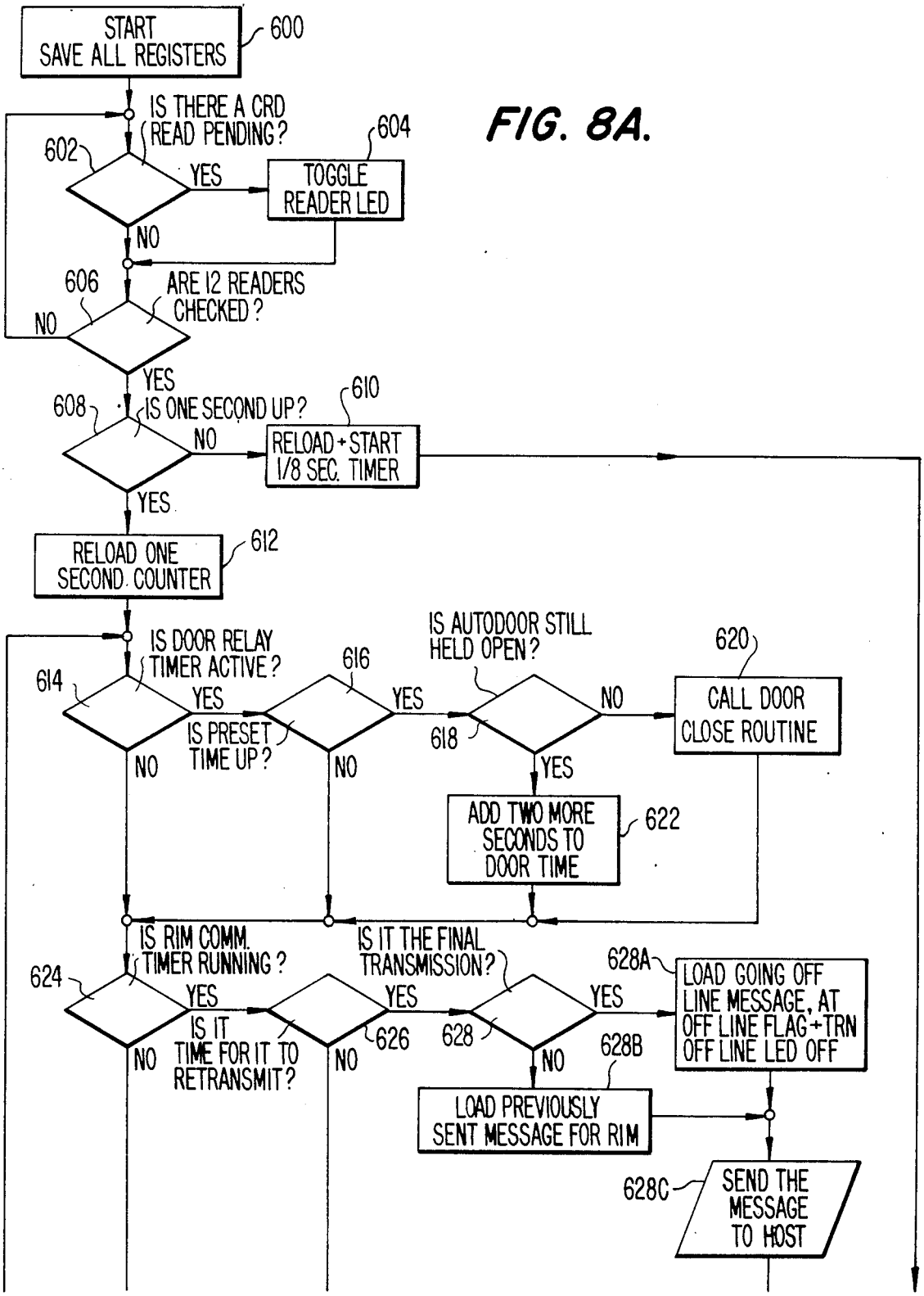
Figure 8C:
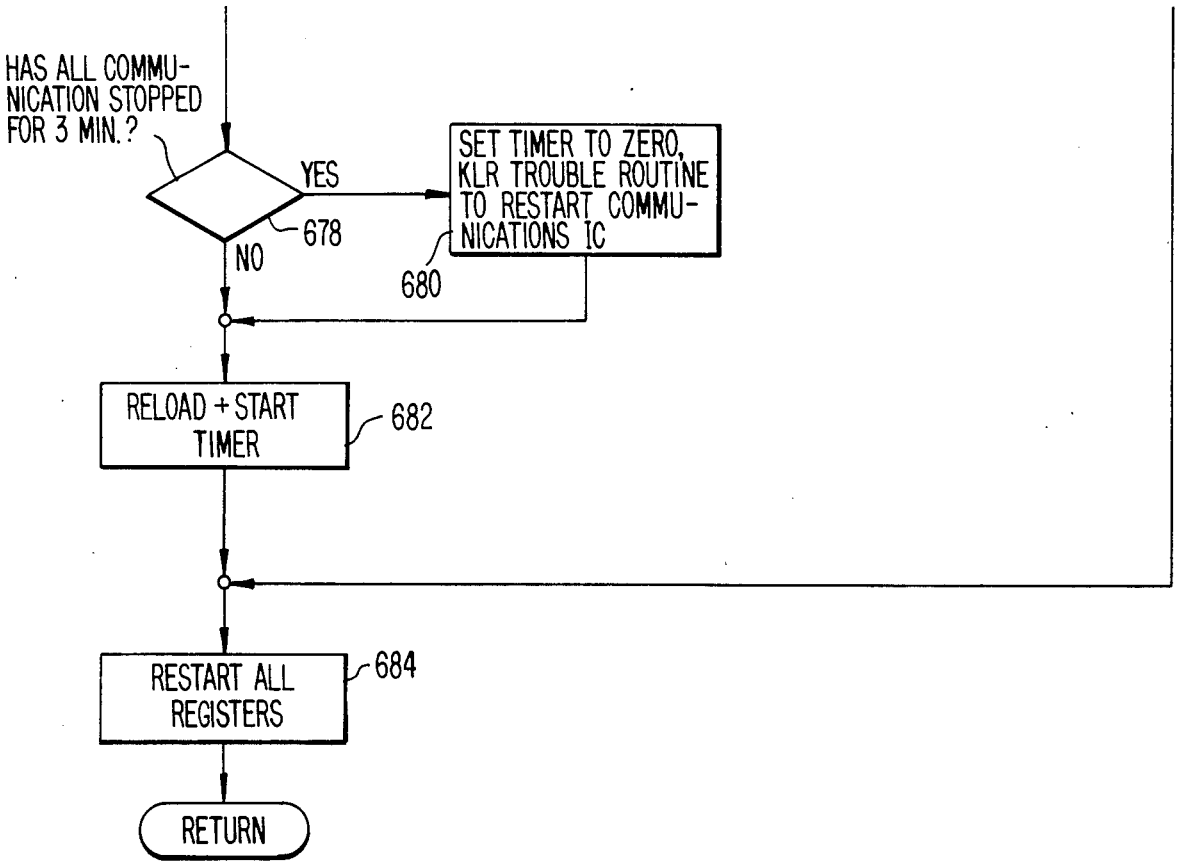

The logic flow of the timer interrupt routine is shown in FIGS. 8A–8C. This routine executes every 1/8 second as determined by the timer 85 of FIG. 4. The Timer Interrupt routine begins at block 600 at which all registers of the control logic 78 are saved. Next, at block 602 a determination is made whether a card read is pending. If so, an LED on the associated card reader is toggled at block 604. Since the timer interrupt routine executes every ⅛ of a second, the LED on the card reader will blink at a rate of four times per second while a card read operation is pending. The blinking operation is executed for all card readers serviced by this RIM, master control device 16 up to a total of 12 readers (standard complement of four readers plus an expansion reader board of up to eight readers). The blinking LED for the card readers is the only function which must be performed every ⅛ of a second. All other interrupt operations are performed at intervals of one second or longer. Accordingly, at block 608 a determination is made whether a one-second time period has expired. If not, the timer routine reloads the ⅛ second timer at block 610 and exits to permit the Main Loop routine to resume execution.

At block 612, the one-second counter is reloaded and a determination made at block 614 whether the door open timer is active, that is, if the DOOR PWR variable of the external output buffer 88 is active. If so, it is determined at block 616 if the predetermined time period for the door open timer has expired and, if so, a determination made if the electrically locked door is still being held open. That is, at block 618 a determination is made if the DOOR POS variable is active. If not, the Door Close routine is called block 620. If the door is open, two seconds are added to the door open time period at block 622.

At block 624, it is determined whether the RIM communication timer is running. Whenever a message is sent from the master control device 16 to the host computer 13, an acknowledgement is received back from the host upon successful receipt of the message. Whenever a message is sent, the RIM communication timer is set. The timer is reset upon receipt of an acknowledgement.

At block 626, it is determined whether the time period of the RIM communication timer has expired and if so, the message is retransmitted. The master control device 16 keeps track of the number of such retransmission for each message, up to a predetermined maximum number of retransmissions as determined from the host computer. At block 628, it is determined whether this is the final such retransmission. If so, at block 628A the "going-off line message" is loaded into the communication buffer, the off-line flag is set and the on-line LED located inside the master control device 16 is turned off.

Figure 10:
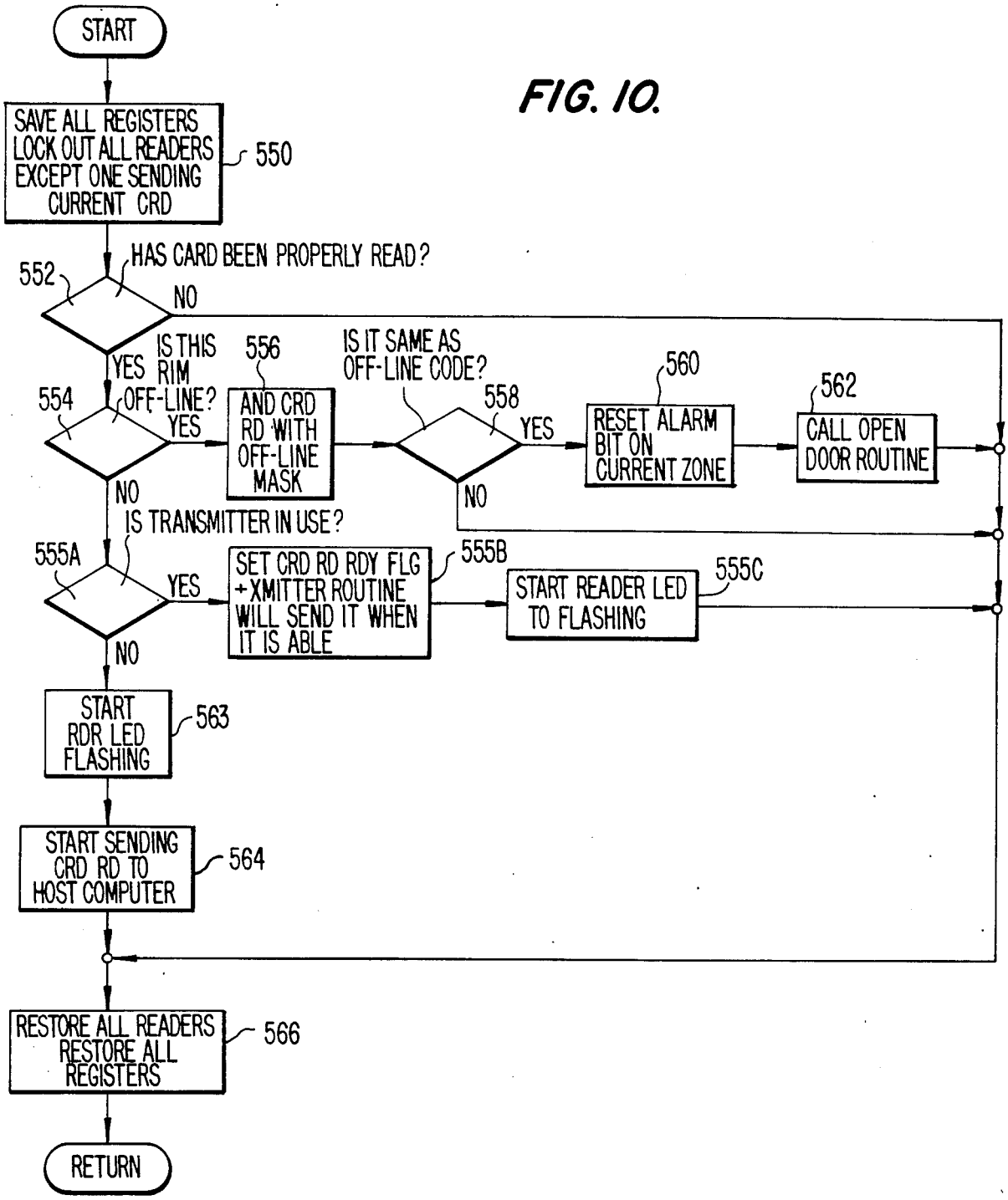

If this is not the final retransmission, the previously sent message is loaded into the communication buffer at block 628B. At block 628C, the contents of the communication buffer are sent to the host computer 13. A determination is made at block 629 (FIG. 8B) if a Card Read was pending. If so, the RIM card read routine shown in FIG. 10 is called.

At block 630 on FIG. 8B, it is determined if the RIM 3-minute communication timer has expired. In order to maintain maximum reliability for the entire system, the host computer 13 generates a message to each RIM at least every minute, even if no data is to be passed. Thus, at block 630 a determination is made if the three-minute communication timer is running. At block 632, it is determined whether this timer period has expired and if so, at block 634 the three-minute timer is turned off, the acknowledged communication timer is set, the retry count is loaded and the off-line message is loaded in the communication buffer. This is so that the RIM will be properly set into offline mode whenever communication with the host is lost for 3 minutes. This message is sent at block 636.

At block 638, it is determined whether the lock sense timer is running. This timer is started whenever the electrically locked door bolt is activated. A determination is made at block 640 whether the door has been opened 30 seconds. If so, this is an indication that the door has been propped open, a condition which the host should be aware of since it represents a possible loss of access control. Thus, at block 642 the PROP variable is activated in the host input buffer 82. The contents of the host input buffer 82 are then sent to the host at block 646.

Since each master control device has a potential to operate up to 12 authorized entry devices, and thus has a potential capacity of up to 12 RIMs, a determination is made at block 648 of whether all RIMs on this master control device have been serviced. If not, the timer interrupt routine returns to block 614 to sequentially service the remaining RIMs.

At block 650, it is determined whether a two-second time period has elapsed since last execution of the remainder of the timer interrupt routine. If not, the ⅛ second timer is restarted at block 650 and the timer interrupt routine exited. If two seconds have expired, the two-second counter is reloaded at block 654 and a determination is made at block 656 if the perimeter prop timer is running. This timer is operated whenever the perimeter loop 51 has been activated, and if the timer has expired as determined by block 658, the PERIMETER PROP variable is set in the host input buffer at block 660, and this buffer transmitted to the host at block 662. Again, normal entry and exit through the perimeter doors monitored by the perimeter loop 51 is not transmitted to the host computer. However, if the door remains opened for more than a predetermined period of time, this is an indication of a possible abnormal condition and the host computer is so informed.

At block 664, it is determined whether the access timer is running. This timer is set whenever a zone is operated from secure mode to the access mode, while the zone is in the autosecure condition. If the timer is running and if the time period thereof has expired as determined by block 666, the timer is turned off at block 668 and a flag set for use by the Zone Board routine to cause the Zone Board routine to automatically return the zone to the secure mode.

At block 670, a determination is made as to whether a siren timer is running and if its five-minute time period has expired, as determined by block 672. If so, the siren timer is turned off at block 674 and a flag set for use by the Zone Board routine which will silence the siren on the next execution of the zone board routine.

A determination is made at block 676 as to whether all zones have been properly serviced by the timer interrupt routine. If not, the routine returns to block 664 to service the remaining zones.

At block 678 of FIG. 8C, a determination is made of whether the three-minute "all communications" timer has expired; that is, if no communications whatsoever have been received by this master control device 16 for three minutes. This would be an indication that the communication interface 83 has possibly failed. Accordingly, at block 680 the timer is reset to zero and a flag set for use by a trouble routine to restart the communication interface 83.

At block 682 of FIG. 8C, the ⅛ second timer is reloaded and restarted to complete execution of the timer interrupt routine. All registers of the control logic 78 are restored at block 684 to their condition prior to the occurrence of the timer interrupt and the Timer Interrupt routine is exited.

Figure 9A:
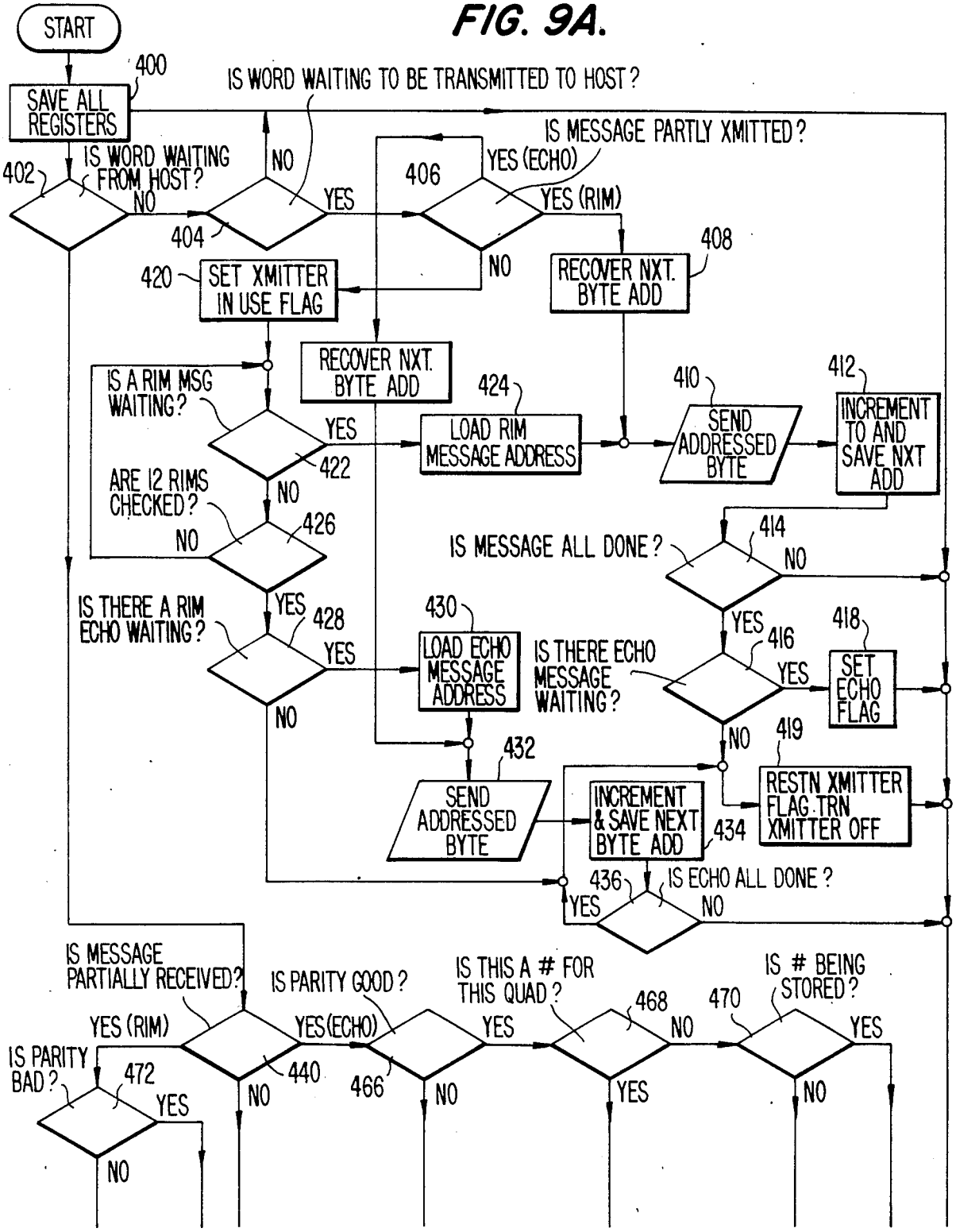
Figure 9B:
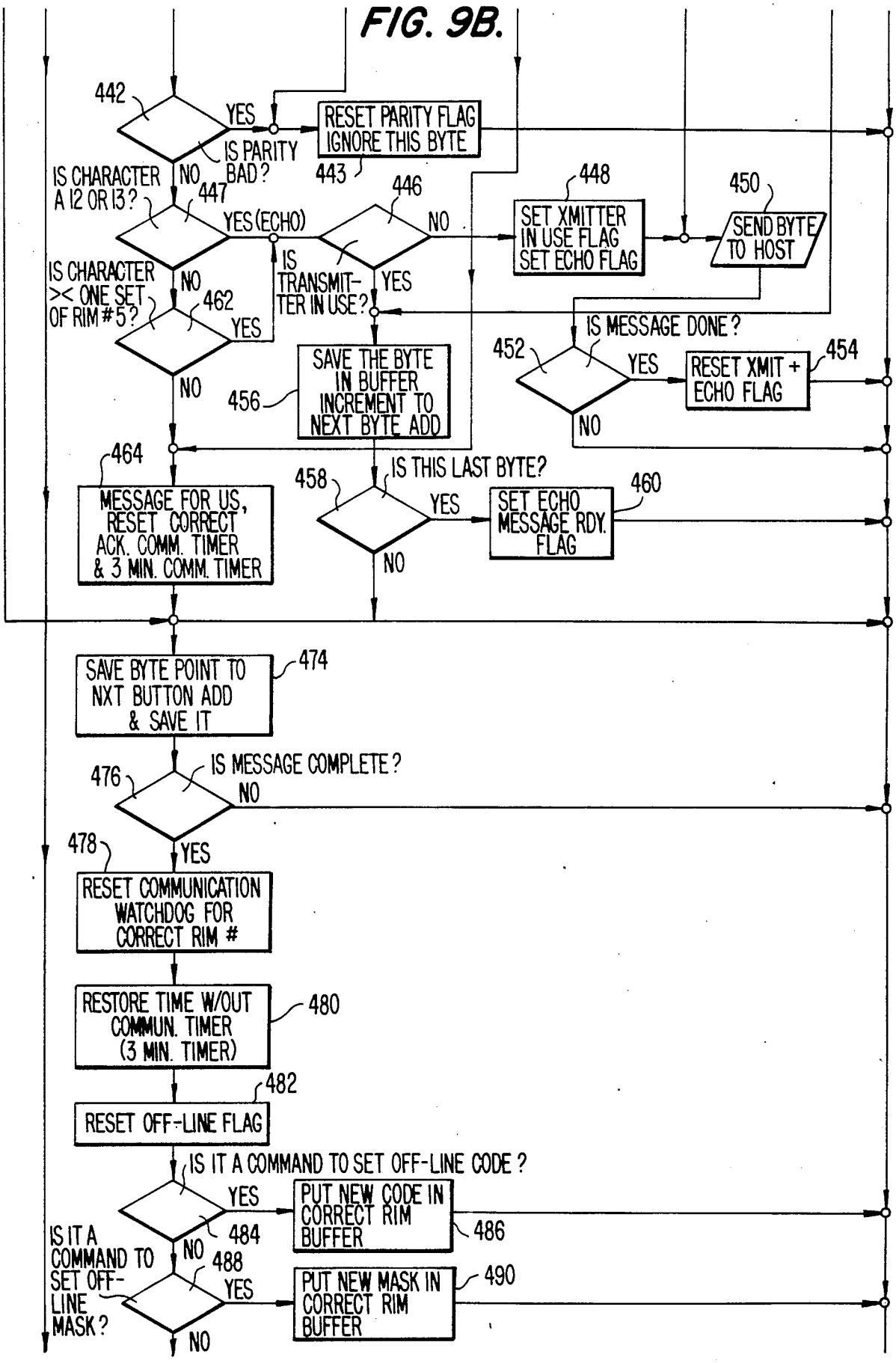
Figure 9C:
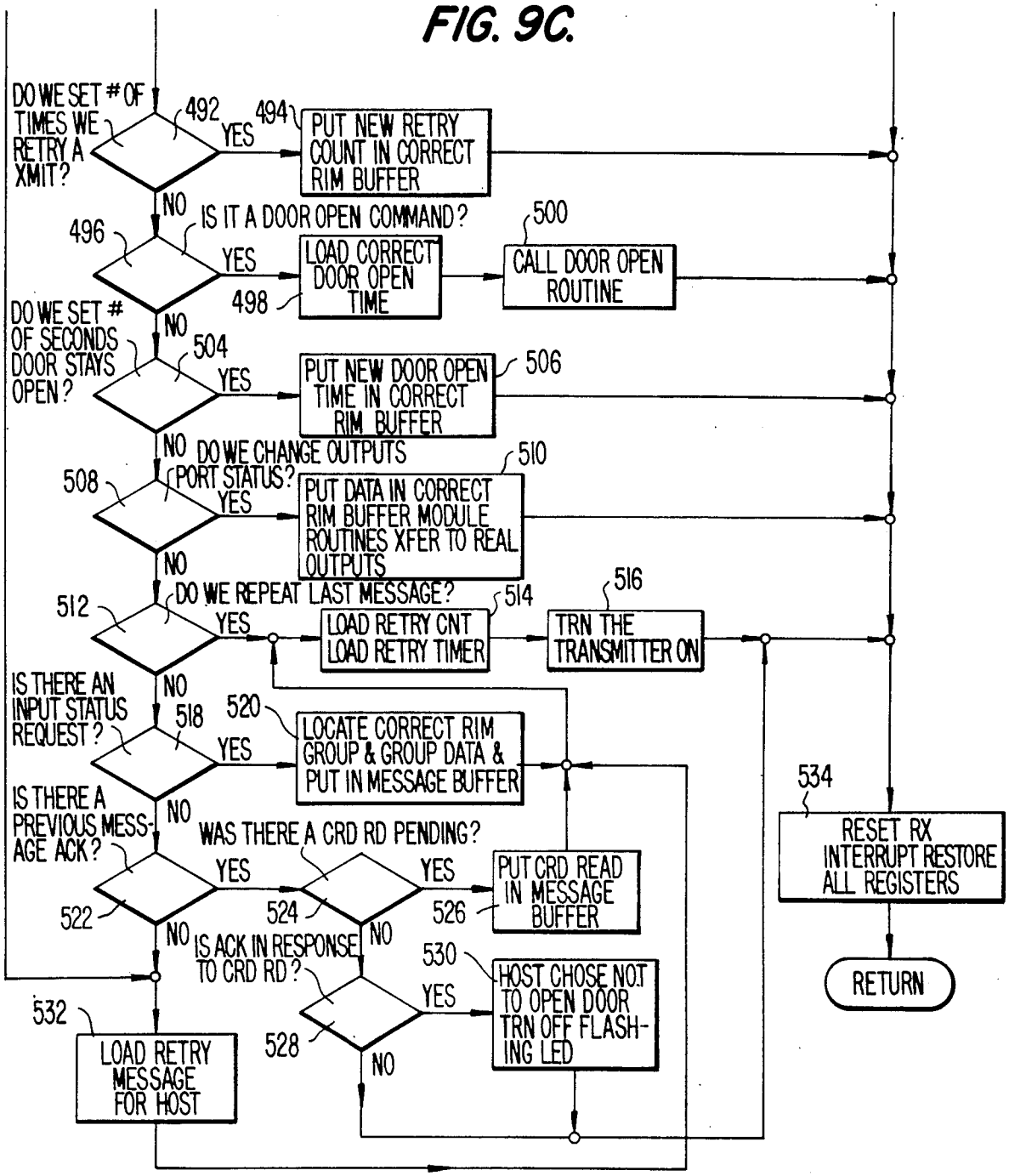

The Communication Interrupt routine is shown in FIGS. 9A through 9C. This routine is entered whenever an interrupt is generated by either the control logic 78 as a result of a desire to transmit a message or by the communication interface 83 as a result of the receipt of an incoming message from either the host or another master control device 16. As can be seen in FIG. 1, a plurality of master control device 16 may be connected in a loop configuration at each remote station 14.

Each message transmitted over the communication lines 24, 26, and 28 consists of a plurality of 7-bit bytes. The first byte in each message is a RIM address having a value of 0–77 (octal). Next, is a function code having a value of 100–177 which specifies the type of message. Following the function code may be any number of data bytes each having a value of 100 plus the data value. Finally, an end-of-message byte having a value of 15 is transmitted to terminate the message.

In normal operation, requests for entry through an electrically locked door are passed through the host computer 13. That is, a determination is made as to whether the holder of a specific number which is unique to the identification card placed in the card reader will be allowed to enter through the electrically locked door. The number encoded on the identification card is split into two portions, an off-line code and an individual ID number. During normal operation, both the off-line code and the individual ID number are scrutinized by the host computer in determining whether entry should be permitted. However, under certain conditions it is possible that communication channels between the individual RIMs of the remote station 14 and the host computer can become overloaded. Because a RIM may not receive an acknowledgement from the host of one of its messages, the RIM may go into the off-line mode. When a RIM is off-line, requests for entry through card readers will be serviced locally at each RIM. However, only the off-line code is checked, not the individual ID number. In standard practice, all users associated with an electrically locked door will have the same off-line code but a unique individual ID number. The host computer will communicate the off-line code for each RIM to the specified RIM. Thus, when a RIM is off-line all users having the same off-line code will be permitted entry by the RIM. Messages for each RIM are transmitted from the host computer to the first master control device 16 at the remote station 14. If the message is addressed to a RIM associated with this master control device it will be processed accordingly. If, however, it is addressed to a RIM at a downstream master control device 16, the message is repeated, or echoed, by the first master control device on a byte-for-byte basis to the downstream master control device.

The Communication Interrupt routine stored in program memory 86 of the master control device 16 will now be described. At block 400, all registers of the control logic 78 are saved and a determination made at block 402 as to whether the interrupt which called the communication interrupt routine was produced by a message word arriving from the host computer. If not, a determination is made at block 404 of whether the interrupt generated by a message to be transmitted from this RIM to the host. If not, the communication routine is exited. Otherwise, it is determined at block 406 whether if the message is partly transmitted, that is, the word waiting to be sent to the host is other than the first word of a message. If so, and if this is a message that was actually generated by this RIM (as opposed to a message generated by another RIM which is being echoed to a downstream master control device) the address of the next byte to be transmitted is determined at block 408 and sent at block 410 over the appropriate transmission line 26 or 28. The address of the next byte to be transmitted is then determined and saved at block 412 and a determination made at block 414 of whether this represents the conclusion of the message. If not, the routine is exited. Otherwise, a determination is made at block 416 of whether there is an echoed message waiting to be transmitted. If so, an echo flag is set at block 414 and the routine is exited. Otherwise, the transmitter flag is restored and the transmitter of the communication interface 83 turned off at block 418. The routine is then exited.

If it is determined at block 406 that the message is not partly transmitted, that is, the byte waiting to be transmitted represents the first byte of a message, the transmitter-in-use flag is set at block 420 and a determination made at block 422 whether a message generated by this RIM is waiting to be transmitted. If so, the address of the RIM message is determined at block 424 and the byte is transmitted in blocks 410 through 419 in the manner described previously. If there is not a message from this RIM waiting to be transmitted, a determination is made at block 426 if all RIMs for this master control device have been serviced. If not, the remaining RIMs are serviced beginning at block 422.

If it is determined that no RIMs in this master control device have a message waiting to be transmitted, a determination is made at block 428 as to whether there is an echoed message waiting to be transmitted, that is, a message generated by an upstream master control device 16 which was received and stored by this master control device until such time as all messages generated by its RIMs could be transmitted. If not, the routine advances to block 419 in the manner previously described. If there is an echoed message waiting to be transmitted, the address of this message is loaded at block 430 and the first byte transmitted at block 432. The address of the next byte to be transmitted is then calculated at block 434 and a determination made at block 436 of whether the echoed message transmission has been completed. If not, the routine is exited. Otherwise, the transmitter flag is restored and the transmitter turned off at block 419.

If it was determined at block 402 that the communication interrupt was generated by the arrival of a message from the host, a determination is made at block 440 of whether the byte waiting is part of a message, the beginning of which has been previously received. If not, then the byte waiting represents the first byte of an incoming message and a determination is made at block 442 (FIG. 9B) as to whether the byte has been received with a parity error. If not, a determination is made at block 444 of whether the received byte is a 14 or 15 (octal). These two RIM addresses are not assigned to any RIMs in any remote station 14, but are used by the host computer to generate a message which will be echoed by each master control device 16 at the remote station 14 and return to the host computer. In this manner, the host computer can determine whether the integrity of the communication loop through the remote station 14 is maintained. If the received byte is a 14 or 15, then it is determined at block 446 whether the transmitter is now in use, and if not, the transmitter in use flag and echo flag are set at block 448. The received byte is then transmitted to the host at block 450 and a determination is made 452 of whether the message has been completed. If not, the routine is immediately exited. Otherwise, the transmit and echo flags are reset at block 454 prior to exiting the routine.

If it is determined at block 446 that the transmitter is now in use, that is, the transmitter is in the process of sending a message generated by this RIM, then the incoming byte is saved at block 456 and the address of the next available storage location in memory for storage of subsequent byte is determined. Next, it is determined whether block 458 is the last byte, that is, if this is the end of message character 15 (octal). If not, the routine is immediately exited. Otherwise, the echo message ready flag is set at block 460 prior to exiting a routine.

If it is determined at block 447 that the incoming byte is not a 14 or 15, then it is determined at block 462 whether the value of the RIM address in this first character of the received address is greater than or less than the RIM numbers associated with this master control device 16. If so, the message is not destined for this master control device and is an echo message to be processed to blocks 446 through 460. If the incoming character is equal to the RIM address associated with this master control device as determined by block 462, the acknowledge communication timer and three-minute communication timers are reset at block 464. Again, time out of either of these timers is an indication of a communication failure. Thus, if an incoming message has been received for a RIM associated with this master control device, then the communication facilities are functioning normally and the failure timer should be reset.

If the parity of the received byte is bad, then the parity flag is reset at block 443 to ignore this incoming byte and the routine exited. If it is determined at block 440 that the incoming byte represents the next byte in an echoed message the beginning of which is already received, a determination is made at block 466 of whether a parity error has occurred on this byte. If so, the parity flag is set at block 443 and the routine exited. Otherwise, a determination is made at block 468 if this message is addressed to a RIM on this QUAD. If so, the byte is processed at block 464. Otherwise, a determination is made of whether this message is being stored since the transmitter busy flag is set. If not, the byte is transmitted as described in block 450 through block 454. Otherwise, the byte is processed as described in blocks 456 through 460.

If this byte is part of a message addressed to this RIM as determined at block 440, and if the parity on this block is bad, a retry message will be generated in a manner to be described below. Otherwise, the byte is saved in a buffer memory and the address of the next available memory storage location computed at block 474. If the message is not complete, as determined at block 476 then the routine is immediately exited. Otherwise, the watchdog communication and three-minute communication timers are reset at blocks 478 and 480, respectively. The off-line flag is reset at block 482 and determination made at block 484 of whether this is a command to set the off-line code for this RIM. As discussed above, this is a code which is used when card reader entry requests are to be processed locally by this RIM, rather than by the host computer.

If this is a command to set the off-line code for this RIM, the new off-line code is stored at block 486 in a buffer associated with this RIM and the routine exited. Otherwise, a determination is made of whether this message is a command to set a new off-line mask, a quantity also used when the RIM is in the off-line mode. If so, the new mask is stored at block 490 in the correct buffer for this RIM and the routine exited. Otherwise, a determination is made at block 492 (FIG. 9C) as to whether the incoming message represents a specification by the host computer of the number of times a message to the host will be transmitted before determining that a communication failure has occurred. If so, the new retry count is placed in the correct buffer at block 494 and the routine exited. Otherwise, it is determined at block 496 if this message represents the command to open the electrically locked door associated with this RIM. If so, the correct door open time is loaded at block 498. The door open time is the interval during which the door remains unlocked in response to an entry or an exit request. Since this message tells the RIM that an authorized entry is occurring, any alarm condition occurring on the zone associated with this RIM is reset at block 500. The Door Open routine is called at block 502 and the communication interrupt routine exited.

Referring to FIG. 9C if the incoming message represents a specification of the number of seconds a door is allowed to remain unlocked, as determined at block 504, the new door open time is stored in the correct RIM buffer location at block 506 and the routine exited. If this message represents a change in a variable in the host output buffer 84, as determined at block 508, the incoming message data is written into host input buffer 82 at block 510 and the routine exited.

A determination is made at block 512 as to whether the incoming message represents a request from the host to repeat the last message which was transmitted from this RIM. If so, the retry count and retry timer are loaded and set at block 514, the transmitter turned on at block 516, and the routine exited. It is then determined at block 518 whether the incoming message represents an input status request. If so, the host output buffer 84 for this RIM is loaded at block 520 and the message processed at blocks 414 and 416 as previously described.

Finally, at block 522 it is determined whether the incoming message is an acknowledgement of a previous message transmitted by this RIM. If so, it is determined at block 524 if a card read was pending. If so, the information read from the card is placed in the message buffer and the message processed as described previously in blocks 514 and 516. Otherwise, it is determined at block 528 whether the acknowledgement is in response to a card read; if not, the outine is immediately exited. Otherwise, this is an indication that the host has declined to open the electrically locked door in response to a card read processed by this RIM. The flashing LED and the associated card reader is turned off at block 530 and the routine exited. If it is determined at block 522 that this is not an acknowledgement of a previous message, then the previous message will be loaded at block 522 and retransmitted to the host through blocks 514 and 516. It should be noted that each indication of an exit from the communication interrupt routine, block 534 is first executed such that the communication interrupt is reset and all registers are restored.

The logic of the Card Reader Interrupt routine is shown in FIG. 10. Whenever an identification card is inserted into a card reader or a number sequence keyed into a numeric keypad, the associated authorized entry device generates an interrupt to the control logic 78 and supplies the value of the identification code obtained from either the identification card or the keypad entry sequence, as appropriate. The card reader interrupt routine is then executed. At block 550, the routine saves all registers of the control logic 78 and locks out all readers except the one sending the current value. A determination is made at block 552 as to whether the card has been properly read. If not, the routine is immediately exited. Otherwise, a determination is made at block 554 as to whether this RIM is currently off-line, that is, whether the host has indicated that the RIM is to determine locally whether an entry should be permitted. If so, a logical AND is performed at block 556 between the value received from the card reader and the off-line mask previously stored in the RIM by a message from the host computer. A determination is then made at block 558 of whether the result of the operation of block 556 is the same as the off-line code also previously stored by the host computer in the RIM. If not, the routine is immediately exited. Otherwise, the card read is treated as a valid entry request and the alarm bit on the proper zone is reset at block 560. The Open Door routine is called at block 562 and the routine exited.

If a determination at block 554 that the RIM is not off-line, then a determination is made at block 555A if a transmitter is currently in use. If so, the card read ready flag is set at block 555B so that the Communication Interrupt routine will transmit the card read value to the host as soon as the transmitter is available. The card reader LED is set flashing at block 560C and the routine exited. If the transmitter is currently free as determined by block 555A, then the reader LED is set flashing at block 563. The card read message is then transmitted to the host at block 564. Exit routine operations are then performed at block 566 by restoring all readers and registers. Execution of the card reader interrupt routine is not complete.

It will be apparent to these skilled in the art that various modifications and variations can be made in the access control and security alarm apparatus and method of the present invention without departing from the scope or spirit of the invention. Thus, it is intended that the present invention cover the modifications and variations of this invention provided they come within the scope of the appended claims and their equivalents.

We claim:

1. Access control and security alarm apparatus, comprising:

a plurality of sensors activated in response to predetermined conditions;

an alarm indicator;

control means for activating said alarm indicator upon activation of at least one of said sensors; and a master reset input device for selectively placing said control means into a normal mode wherein said alarm indicator remains activated independent of the condition of said sensors, and into a master reset mode wherein if said alarm indicator has been activated, said control means deactivates said indicator when all of said sensors are deactivated.

2. Apparatus as recited in claim 1 wherein said sensors are serially connected in a loop and each of said sensors produces an open circuit in said loop when activated.

3. Apparatus as recited in claim 2 wherein said control means comprises means for discontinuing a produced alarm signal whenever said control means is in said master reset mode and said alarm loop is sensed to be a closed circuit.

4. Access control and security alarm apparatus responsive to control signals, said apparatus comprising:

a plurality of sensors activated in response to predetermined conditions and defining a protective zone;

an alarm indicator;

control means connected to said sensors and said alarm indicator for responding to said control signals by placing said apparatus in an access mode preventing activation of said alarm indicator upon activation of said sensors or in a secure mode wherein activation of one or more of said sensors will result in activation of said alarm indicator, and for responding to an autosecure control signal by immediately placing said apparatus in said secure mode if one of said sensors are activated or, if one or more of said sensors are activated at the time of receipt of asid autosecure control signal, placing said apparatus in said secure mode, when all sensors become inactive; and a central station outside said protective zone and a communication channel connecting said central station including means for generating and transmitting said autosecure control signal to said control means.

5. Apparatus as recited in claim 4 wherein said control means is selectively operable in response to an arm signal from said central station between an arm mode permitting generation of an alarm signal and a disarmed mode preventing generation of an alarm signal.

6. Apparatus as recited in claim 4 wherein said sensors are formed into independent zones and said control means includes means for selectively and independently operating each zone to either access mode or secure mode.

7. Apparatus as recited in claim 6 wherein said control means comprises means responsive to an arm control signal from said central station for selectively placing each zone independently of every other zone into either an arm mode permitting generation of an alarm signal or a disarm mode preventing generation of an alarm signal.

8. Access control and security alarm apparatus associated with a remotely operated access control system including an entry authorization device for generating an entry request signal upon operation by a person desiring entry, an electrically locked door selectively operable between a locked condition preventing entry and an unlocked condition permitting entry, and a door position indicator activated upon opening of an associated door, said apparatus comprising:

a plurality of sensors activated in response to a predetermined condition, said sensors connected in groups to form protective zones;

a plurality of alarm indicators each associated with one of said zones;

control means for detecting activation of said sensors and for activating the alarm indicator associated with the zone containing an activated sensor; and means for selectively coupling said remotely operated access control system with any of said zones such that unauthorized opening of an associated door causes said control means to activate the alarm indicator associated with said coupled zone.

9. Apparatus as recited in claim 8 wherein said selective coupling means includes a memory device connected to said control means for storing a quantity representative of the specific zone in which said remotely operated access control system is connected.

10. Apparatus as recited in claim 8 comprising a plurality of said remotely operated access control systems, and wherein said coupling means selectively couples any of said remotely operated access control systems to any of said zones.

11. Apparatus as recited in claim 8 wherein said selective coupling means comprises a memory device having a plurality of storage locations each associated with one of said remotely operated access control systems, and said control means comprises means for storing in each of said storage locations a quantity representative of the specific zone to which the remotely operated access control systems associated with that storage location is coupled.

12. Apparatus as recited in claim 8 wherein said coupling means includes means fixedly associated with said remotely operated access control systems for storing a value uniquely identifying one of said zones and means for generating an electrical signal to said control means corresponding to said stored value.

13. A method for testing access control and security alarm apparatus which includes a plurality of sensors activated in response to predetermined condition and a control device which causes an alarm signal upon activation of the sensors, said method comprising the steps of:

generating a signal to switch a control device from a normal mode, wherein an alarm signal resulting from activation of a sensor continues until either a predetermined time period expires or a reset signal is generated, to a master reset mode, wherein an alarm signal resulting from activation of a sensor continues only so long as one or more sensors remain activated, activating a first sensor and testing the production of an alarm signal in response thereto, deactivating the first sensor to terminate production of the alarm signal, and repeating the steps of activating and deactivating for each sensor in the system being tested, whereby proper production of an alarm signal in response to activation of each sensor can be verified.

14. A method as recited in claim 13 wherein said step of activating a sensor includes the steps of generating the condition to which the sensor is responsive and said step of deactivating a condition detecting sensor includes the steps of removing the condition to which the sensor is responsive.

15. A method as recited in claim 14 for testing a system having a plurality of groups of sensors in which activation of one sensor results in production of an alarm signal associated with the group of the activated sensor, wherein the step of generating the mode switching signal includes the step of switching modes for all groups of sensors.

16. A method for providing security to a protected area having at least one entry point and protected by an alarm system having a master control device located in proximity to the protected area and a central station remotely located from the master control device and connected thereto over a communication channel, and in which an alarm signal is generated only when the system has been placed in both an arm mode and a secure mode, said method comprising the steps of:

placing the system in an arm mode and a secure mode;

removing the system from the secure mode upon request for an authorized entry to the protected area, whereby an entry to the protected area will not result in generation of an alarm signal; and automatically reestablishing the secure mode after expiration of a predetermined delay period following removal of the system from the secure mode.

17. A method as recited in claim 16 wherein detection of an entry is performed by sensing the opening of a door operable between open and closed positions and wherein the step of reestablishing the secure mode includes the step of testing for expiration of the delay period if the door is closed at that time, or testing for a closed condition of the door if the door is open at the expiration of the delay period, and reestablishing said secure mode when either of said tests are met.

18. A method as recited in claim 17 comprising the additional step prior to the first step of claim 16 of switching the master control device from a normal mode wherein the secure mode is not reestablished following an authorized entry request, to an autosecure mode, wherein the secure mode is automatically reestablished after an authorized entry request.

19. A method as recited in claim 18 comprising the additional steps of generating a control signal to selectively operate the master control device between the normal mode, wherein the secure mode remains removed after an authorized entry request, and an autosecure mode, wherein the secure mode is automatically reestablished after being removed in response to an authorized entry request.

20. A method as recited in claim 19 wherein the control signal is generated at the central station.

21. A method as recited in claim 19 wherein generation of the control signal to operate the master control device to the autosecure condition results in establishment of the secure mode: (1) immediately if the door is closed at the time of generation of the control signal or (2) at the time the door is closed if the door is open at the time of generation of the control signal.

22. A method as recited in claim 19 wherein the protected area includes a plurality of zones each having a door, and wherein said method comprises the additional steps of generating a separate control signal for each zone so that each zone is in either a normal mode or an autosecure condition independent of all other zones.

23. Access control and security alarm apparatus responsive to control signals, said apparatus comprising:

a plurality of sensors activated in response to predetermined conditions;

an alarm indicator; and control means connected to said sensors and said alarm indicator for responding to a first one of said control signals by placing said apparatus in an access mode preventing activation of said alarm indicator upon activation of said sensors, for responding to a second one of said control signals by placing said apparatus in a secure mode wherein activation of one or more of said sensors will result in activation of said alarm indicator, and for responding to a third one of said secure mode if none of said sensors are activated or, if one or more of said sensors are activated at the time of receipt of said third control signals, placing said apparatus in said secure mode when all sensors become inactive, said control means, after receipt of said third control signal and after receipt of said first control signal, placing said apparatus in said secure mode a predetermined time period after receipt of said first control signal if none of said sensors are activated and for placing said apparatus in said secure mode when all of said sensors become deactivated if at least one of said sensors was activated at the expiration of said predetermined time period.

* * * * *